US007358016B2

(12) United States Patent
Fujiki et al.

(10) Patent No.: US 7,358,016 B2
(45) Date of Patent: Apr. 15, 2008

(54) ELECTROPHOTOGRAPHIC PHOTORECEPTOR AND ELECTROPHOTO-GRAPHIC APPARATUS EQUIPPED WITH THE SAME

(75) Inventors: Tsuyoshi Fujiki, Osaka (JP); Hiroki Sakamoto, Osaka (JP); Hiroaki Murase, Osaka (JP); Masashi Tanaka, Osaka (JP); Shinichi Kawasaki, Osaka (JP); Mitsuaki Yamada, Osaka (JP)

(73) Assignee: Osaka Gas Co., Ltd., Osaka (JP)

( * ) Notice: Subject to any disclaimer, the term of this patent is extended or adjusted under 35 U.S.C. 154(b) by 440 days.

(21) Appl. No.: 10/521,813

(22) PCT Filed: Jul. 18, 2003

(86) PCT No.: PCT/JP03/09163

§ 371 (c)(1),
(2), (4) Date: Jan. 21, 2005

(87) PCT Pub. No.: WO2004/019136

PCT Pub. Date: Mar. 4, 2004

(65) Prior Publication Data

US 2005/0238975 A1 Oct. 27, 2005

(30) Foreign Application Priority Data

Jul. 23, 2002 (JP) ..... 2002-214336

(51) Int. Cl.
*G03G 15/04* (2006.01)

(52) U.S. Cl. ..... 430/66

(58) Field of Classification Search ..... 430/66
See application file for complete search history.

(56) References Cited

U.S. PATENT DOCUMENTS 3,873,312 A 3/1975 Contois et al.
5,858,541 A 1/1999 Hiraoka

FOREIGN PATENT DOCUMENTS

JP 50-2279 1/1975

(Continued)

OTHER PUBLICATIONS

European Search Report dated Nov. 25, 2003 for International Application No. PCT/JP03/09163.

(Continued)

*Primary Examiner*—Mark A. Chapman
(74) *Attorney, Agent, or Firm*—Pillsbury Winthrop Shaw Pittman LLP

(57) ABSTRACT

A top surface layer of an electrophotographic photosensitive element (e.g., a charge-transporting layer) is rendered to contain a cyclic polysilane represented by the following formula (1).

(1)

In the formula, $R^1$ and $R^2$ are the same or different from each other and each represents a group such as an alkyl group, an aryl group, and "m" denotes an integer of not less than 4.

The cyclic polysilane may be a copolysilane. The content of the cyclic polysilane may be about 0.01 to 10% by weight relative to the whole components of the top surface layer.

20 Claims, 3 Drawing Sheets

FOREIGN PATENT DOCUMENTS

| | | |
|---|---|---|
| JP | 50-43813 | 4/1975 |
| JP | 50-98181 | 8/1975 |
| JP | 50-2278 | 10/1975 |
| JP | 55-42380 | 3/1980 |
| JP | 60-145550 | 8/1985 |
| JP | 60-148917 | 8/1985 |
| JP | 61-23154 | 1/1986 |
| JP | 61-132954 | 6/1986 |
| JP | 7-113779 | 3/1988 |
| JP | 63-061256 | 3/1988 |
| JP | 3-111854 | 5/1991 |
| JP | 4-178652 | 6/1992 |
| JP | 4-189873 | 7/1992 |
| JP | 4-334551 | 11/1992 |
| JP | 4-371962 | 12/1992 |
| JP | 5-2278 | 1/1993 |
| JP | 5-2279 | 1/1993 |
| JP | 4-43813 | 2/1993 |
| JP | 5-98181 | 4/1993 |
| JP | 5-263007 | 10/1993 |
| JP | 5-279591 | 10/1993 |
| JP | 5-297617 | 11/1993 |
| JP | 6-145550 | 5/1994 |
| JP | 6-148917 | 5/1994 |
| JP | 6-271786 | 9/1994 |
| JP | 7-113779 | 5/1995 |
| JP | 7-173112 | 7/1995 |
| JP | 8-62874 | 3/1996 |
| JP | 8-295537 | 11/1996 |
| JP | 10-69110 | 3/1998 |
| JP | 11-288110 | 10/1999 |
| WO | 98/29476 | 7/1998 |

OTHER PUBLICATIONS

N. Lalitha et al., "Sequential Addition of 2-Potassio-2-nitropropane and Oxygen to 4-Arylidene-oxazol-5-ones: A New Method for 2-Aryl Buenoic Acid Imides", Journal of the Chemical Society, pp. 897-899, (1991).

Kazuaki Furukawa et al., "Optical Properties of Silicon Network Polymers", Macromolecules, American Chemical Society, pp. 3423-3426, (1990).

Kenkichi Sakamoto et al., "Highly Ordered High Moelcular Weight Alternating Polysilylene Copolymer Prepared by Anionic Polymerization of Masked Disilene", Macromolecules, American Chemical Society, pp. 4494-4496, (1990).

Koichi Mikami et al., "Anomalous threo-Diastereoselectivity in Allylic Silane- or Stannane-Aldehyde Condensation Reactions: New Interpretation of the Antiperiplanar vs. Synclinal Problem on the Transition-state Conformations", Chemical Communications, Royal Society of Chemistry, No. 17, pp. 1161-1163, (Sep. 1990).

Japanese Office Action (with translation) issued in related application, 4 pates, Jan. 19, 2007.

ELECTROPHOTOGRAPHIC PHOTORECEPTOR AND ELECTROPHOTO-GRAPHIC APPARATUS EQUIPPED WITH THE SAME

CROSS REFERENCE TO RELATED APPLICATION

This is the U.S. National Stage of PCT/JP03/09163, filed Jul. 18, 2003, which in turn claims priority to Japanese Patent Application No. 2002-214336, filed on Jul. 23, 2002, both of which are incorporated herein in their entirety by reference.

TECHNICAL FIELD

The present invention relates to an electrophotographic photosensitive element excellent in durability and capable of providing a high definition image over a long period, and an electrophotographic apparatus provided with the electrophotographic photosensitive element.

BACKGROUND ART

Since a surface of an electrophotographic photosensitive element (a surface of a photosensitive layer) undergoes various electrical, chemical or mechanical stresses due to processes such as electrification, exposure, development, transference, and cleaning [for example, wear (or abrasion) and scarring of the surface layer due to repetitive use, and oxidization and degradation of the surface due to ozone generated by corona discharge], durability is required for the surface to these stresses. In particular, along with recent popularization of a roller electrification system, it has become a problem that the surface is worn down accompanied with cutting of bonding of molecules on the photosensitive layer surface caused by arc discharge. Further, demands for full-coloration or speedup of a printer and miniaturization of a photosensitive drum bring about overlap of conditions facilitating stresses in the photosensitive element surface as described above. Therefore, improved durability of the electrophotographic photosensitive element has been further required.

In order to solve such problems concerning the photosensitive element surface, improvement in properties such as surface abrasion, a release property of toner, and a cleaning property is attempted by adding a silicone-series compound or fluorine-containing compound which has a small surface free energy and is excellent in water repellency or lubricity [for example, Japanese Patent Application Laid-Open No. 132954/1986 (JP-61-132954A), Japanese Patent Publication No. 113779/1995 (JP-7-113779B)].

However, since these compounds are low in compatibility or dispersibility to a resin constituting a photosensitive layer of the photosensitive element and inferior in transparency of a top surface layer thereof, it is difficult to obtain a high definition image. Moreover, these compounds incline to be maldistribute in the vicinity of the top of the surface layer. Thereby, even if only the top surface layer is slightly worn by friction or sliding in the surface, a property such as lubricity is drastically reduced or a cleaning property is fast deteriorated by bleeding out of these compounds with passage of time. Further, it is difficult to obtain a sharp image over a long period by such deterioration in the lubricating or cleaning property.

Meanwhile, Japanese Patent Application Laid-Open No. 178652/1992 (JP-4-178652A) discloses a method for improving a durability or a repeating property of a photosensitive element, which comprises adding a polysilane or a copolysilane to a photosensitive layer. This document describes that (i) as the polysilane, there may be used a polysilane or copolysilane whose end is blocked with an alkyl group or the like and which has a relatively high molecular weight (in Examples, a number-average molecular weight of 18000, or 23000); (ii) the mixing ratio of the polysilane is preferably about 20% to 80% relative to a binder resin constituting the photosensitive layer [e.g., a poly(methyl methacrylate)]; and (iii) in a single-layered photosensitive element having a combination of a charge transport function and a charge generation function, it is preferred to add 3 to 7 parts by weight of the polysilane and 3 to 7 parts by weight of the binder resin to 1 to 10 parts by weight of a charge-generating substance.

According to the method of this document, however, since the polysilane inferior to the binder resin in mechanical strength is used in great quantities, this method not only is disadvantageous in cost but also accelerates wear (abrasion) of the photosensitive layer. Moreover, the use of the polysilane having a high-molecular weight gives inadequate compatibility or dispersibility to the resin, deteriorates transparency of the photosensitive layer, and has the potential of impairing sharpness (or clearness) in an image.

It is therefore an object of the present invention to provide an electrophotographic photosensitive element improving water repellency and lubricity (lubricating property) thereof and forming a high quality image (or picture image) over a long period, as well as a method for producing the same.

It is another object of the present invention to provide an electrophotographic photosensitive element which has excellent durability without deterioration in a property such as lubricity or a cleaning property even in the case of wearing a surface layer thereof, and a method for producing the same.

It is still another object of the present invention to provide an electrophotographic photosensitive element which can realize a high definition image without deterioration in mechanical strength or transparency and can ensure conservation of a high-quality image property even with prolonged application, a method for producing the same, and an electrophotographic apparatus provided with the electrophotographic photosensitive element.

DISCLOSURE OF INVENTION

The inventors of the present invention made intensive studies to achieve the above objects and finally found that a small amount of a specific polysilane added to a top surface layer of an electrophotographic photosensitive element ensures conservation of lubricity or a cleaning property over a long period, and realizes a high definition image. The present invention was accomplished based on the above findings.

That is, the electrophotographic photosensitive element of the present invention comprises at least a top surface layer containing a polysilane, wherein the polysilane comprises a cyclic polysilane represented by the following formula (1):

(1)

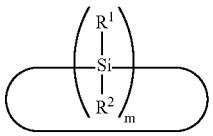

wherein $R^1$ and $R^2$ are the same or different from each other and each represents a hydrogen atom, a hydroxyl group, an alkyl group, an alkoxy group, an alkenyl group, a cycloalkyl group, a cycloalkyloxy group, a cycloalkenyl group, an aryl group, an aryloxy group, an aralkyl group, an aralkyloxy group, or a silyl group; the alkyl group, the alkoxy group, the alkenyl group, the cycloalkyl group, the cycloalkyloxy group, the cycloalkenyl group, the aryl group, the aryloxy group, the aralkyl group, the aralkyloxy group, or the silyl group may have a substituent; "m" denotes an integer of not less than 4; and $R^1$ and $R^2$ may vary depending on the coefficient "m", respectively.

In the formula (1), at least one of $R^1$ and $R^2$ may be an aryl group (such as a phenyl group), and "m" may be an integer of about 4 to 10 (e.g., about 4 to 8, particularly 5).

The cyclic polysilane may be a copolysilane. Such a cyclic polysilane may be, for example, represented by the following formula (1a):

(1a)

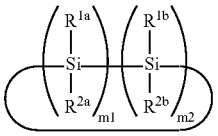

wherein $R^{1a}$ and $R^{2a}$ each represents an aryl group which may have a substituent; $R^{1b}$ and $R^{2b}$ are the same or different from each other and each represents an alkyl group which may have a substituent, a cycloalkyl group which may have a substituent, or an aryl group which may have a substituent; provided that both $R^{1b}$ and $R^{2b}$ are not coincidentally an aryl group which may have a substituent; m1 denotes an integer of not less than 1; m2 denotes 0 or an integer of not less than 1; and m1+m2 denotes an integer of not less than 4.

In the formula, $R^{1a}$ and $R^{2a}$ each may be a $C_{6-10}$aryl group. Moreover, a combination of $R^{1b}$ and $R^{2b}$ may be, for example, (1) a combination of a $C_{1-4}$alkyl group and a $C_{1-4}$alkyl group, (2) a combination of a $C_{1-4}$alkyl group and a $C_{6-10}$ aryl group, (3) a combination of a $C_{1-4}$alkyl group and a $C_{5-8}$cycloalkyl group, or (4) a combination of a $C_{6-10}$ aryl group and a $C_{5-8}$cycloalkyl group. Incidentally, m1 may be an integer of about 1 to 10 (e.g., about 1 to 8), m2 may be an integer of about 0 to 10 (e.g., about 0 to 8), and m1+m2 may be about 4 to 12 (e.g., about 4 to 10).

Further, the polysilane may be a polysilane mixture containing a cyclic polysilane.

The electrophotographic photosensitive element of the present invention comprises at least both of an electroconductive support and a photosensitive layer, wherein the photosensitive layer usually comprises at least the following components: a charge-generating agent, a charge-transporting agent, and a binder resin. The photosensitive layer may comprise a charge-generating layer, and a charge-transporting layer formed on the charge-generating layer. A surface protection layer containing the cyclic polysilane may be formed on the photosensitive layer. Moreover, the content of the cyclic polysilane may be about 0.01 to 10% by weight (e.g., about 0.01 to 5% by weight) relative to the whole components of the top surface layer. For example, the top surface layer comprises an outer surface layer of the photosensitive layer or a surface protection layer of the photosensitive layer, and the proportion of a cyclic homo- or copolysilane having at least a diarylsilane unit may be about 0.01 to 3% by weight relative to whole components of the top surface layer.

The electrophotographic photosensitive element of the present invention may be produced by forming at least a photosensitive layer on an electroconductive support to obtain the electrophotographic photosensitive element, wherein the cyclic polysilane may be incorporated into at least a top surface of the electrophotographic photosensitive element.

The present invention also includes an electrophotographic photosensitive element composition, which comprises a component for an outer surface layer of a photosensitive layer or a component for a surface protection layer of a photosensitive layer, and a cyclic polysilane. The composition may comprise, for example, depending on a structure of the photosensitive layer, a binder (e.g., a polycarbonate-series resin), a cyclic polysilane, and at least one member selected from the group consisting of a charge-generating agent and a charge-transporting agent.

The present invention further includes an electrophotographic cartridge and an electrophotographic apparatus, which are provided with the electrophotographic photosensitive element.

Throughout this specification, the generic name for a polysilane and an oligosilane is a "polysilane". The cyclic polysilane is sometimes generically called a "polysilane", simply.

DETAILED DESCRIPTION OF THE INVENTION

[Electrophotographic Photosensitive Element]

Figure 1:
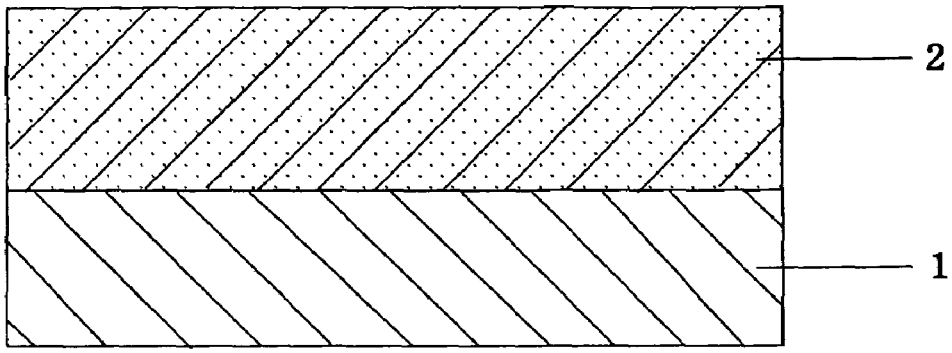
FIG. 1 is a schematic sectional view showing an embodiment of a form of a polysilane contained in a top surface layer.

The electrophotographic photosensitive element of the present invention comprises at least both of an electroconductive support and a photosensitive layer. At least the top surface layer of the electrophotographic photosensitive element comprises a cyclic polysilane.

Incidentally, the cyclic polysilane may be included in at least the top surface layer. For example, the polysilane may be included only in the top surface layer of the photosensitive layer, or may be included throughout the photosensitive layer in accordance with the layer structure of the photosensitive layer or others.

(Electroconductive Support)

As the electroconductive support, there may be used a conventional electroconductive support in a field of an electrophotographic photosensitive element. For example, such a support may include a support comprising a substrate (e.g., a plastic, and a paper) and an electroconductive coat formed thereon with a means such as deposition or sputtering; a support comprising a substrate (e.g., a plastic, and a paper) and an electroconductive fine particle coated on the substrate through a binder (e.g., a plastic, and a paper); and a metal support (e.g., an aluminum plate).

As a material for the electroconductive coat or electroconductive fine particle, for example, there may be mentioned a metal (such as aluminum, nickel, chromium, nichrome, copper, silver, gold, platinum, or an alloy of such a metal), a metal oxide (such as tin oxide or indium oxide), and graphite.

The form (or shape) of the electroconductive support (or the substrate) may be a film (or sheet), a tube, or a (circular) cylinder. The tubular electroconductive support may include a metal tube obtained by molding a plate or matte of a metal (e.g., the above-exemplified metal, an alloy such as an aluminum base alloy or a stainless steel) into a cylindrical form by an extrusion process, a drawing process, or other process, and subjecting the molded product to a surface finishing (e.g., cutting, superfinishing, and grinding).

The thickness of the electroconductive support is not particularly limited to a specific one, and for example, may be about 0.05 to 10 mm, preferably about 0.05 to 8 mm, and preferably about 0.1 to 5 mm. Moreover, in the case where the electroconductive support is in the form of a tube or cylinder, the diameter of the tube or cylinder may for example be about 5 to 300 mm, preferably about 10 to 200 mm, and more preferably about 20 to 150 mm.

(Undercoat Layer or Charge Injection-blocking Layer)

In the electrophotographic photosensitive element of the present invention, if necessary, an undercoat layer (charge injection-blocking layer) may be formed between the electroconductive support and the photosensitive layer (or on the electroconductive support). The formation of the undercoat layer ensures to block charge injection from the photosensitive layer, and to improve adhesiveness of the photosensitive layer to the electroconductive support. The undercoat layer may comprise a binder having high adhesiveness to the electroconductive support, for example, a binder such as a polyvinyl alcohol, a polyvinyl acetal such as a polyvinyl butyral, a heterocycle-containing resin (e.g., a polyvinyl pyridine, a polyvinyl pyrrolidone, and a poly-N-vinylimidazole), a polyethylene oxide, a cellulose ether, or a cellulose ester (e.g., a methyl cellulose, an ethyl cellulose, and a cellulose acetate), an ethylene-acrylic acid copolymer, an ionomer resin, an acrylic resin, a polyamide-series resin (e.g., a linear polyamide-series resin, and a copolyamide), a natural polymer or a derivative thereof (e.g., a glue, a gelatin, and a casein), a phenol resin, an epoxy resin, or a silane coupling agent.

The undercoat layer may be usually formed by dissolving the binder in a solvent (e.g., an alcohol such as methanol), and coating the resultant solution on the electroconductive support. The thickness of the undercoat layer may be about 0.1 to 5 μm, and preferably about 0.2 to 3 μm.

(Photosensitive Layer)

The photosensitive layer may usually comprise a charge-generating agent and a charge-transporting agent. The form of the photosensitive layer formed or laminated on the electroconductive support (or undercoat layer) may be classified broadly into two categories: one is so-called laminated photosensitive layer comprising a layer having a charge generation function (a charge-generating layer) and a layer having a charge transport function (a charge-transporting layer); and the other is so-called single-layered photosensitive layer having a combination of a charge generation function and a charge transport function. Each of these functional layers (the single-layered photosensitive layer, the charge-transporting layer, and the charge-generating layer) may be a single layer, or may comprise a plurality of layers (e.g., two to five layers).

Incidentally, in the laminated photosensitive layer, a layer located on the front face side (e.g., a charge-transporting layer or a charge-generating layer) may constitute a top surface layer. In the single-layered photosensitive layer, the whole photosensitive layer may constitute a top surface layer. Moreover, when the functional layer (the functional layer in the surface side) comprises a plurality of layers, a layer located on the top surface side in the functional layer may constitute a top surface layer.

(Laminated Photosensitive Layer)

In the laminated photosensitive layer, the order (or sequence) to be laminated of the charge-generating layer and the charge-transporting layer on the support is not particularly limited to a specific one. The charge-generating layer may be laminated on the charge-transporting layer, or the charge-transporting layer may be laminated on the charge-generating layer. The charge-transporting layer may be usually formed or laminated on the charge-generating layer. In such an order of lamination, the thickness of the charge-transporting layer is usually larger than that of the charge-generating layer so that a top surface layer containing a polysilane can be formed with the charge-transporting layer. Thereby, the laminated photosensitive layer having such an order has a high durability for a long period even when the layer is worn, and is suitable for use.

In the laminated photosensitive layer, the charge-generating layer may comprise a charge-generating agent alone, or a charge-generating agent and a binder resin.

The charge-generating agent may include, for example, an inorganic charge-generating agent such as selenium or an alloy thereof, or cadmium sulfide; and an organic charge-generating agent such as a phthalocyanine pigment, an azo pigment, a bisazo pigment, a trisazo pigment, a pyrylium dye, a thiopyrylium dye, a quinacridone pigment, an indigo pigment, a polycyclic quinone pigment, an anthanthrone pigment, a pyranthrone pigment, a cyanine pigment, or a benzimidazole pigment. These charge-generating agents may be used singly or in combination.

Among these charge-generating agents, the preferred compound may include a phthalocyanine-series pigment (a metal-free phthalocyanine pigment and a metal phthalocyanine pigment). The metal-free phthalocyanine may include, for example, an α-type metal-free phthalocyanine, a β-type metal-free phthalocyanine, a τ1-type metal-free phthalocyanine, a τ2-type metal-free phthalocyanine, and an x-type metal-free phthalocyanine.

As the metal phthalocyanine pigment, there may be used various metal phthalocyanine compounds containing a transition metal such as the metal of the Group 4A of the Periodic Table of Elements (e.g., titanium, and zirconium), the metal of the Group 5A of the Periodic Table of Elements (e.g., vanadium), the metal of the Group 3B of the Periodic Table of Elements (e.g., gallium, and indium), or the metal of the Group 4B of the Periodic Table of Elements (e.g., tin, and silicon). Examples of the metal phthalocyanine pigment may include oxotitanyl phthalocyanine, vanadyl phthalocyanine, hydroxygallium phthalocyanine, chlorogallium phthalocyanine, chloroindium phthalocyanine, dichlorotin phthalocyanine, dihydroxysilicon phthalocyanine, dialkoxysilicon phthalocyanine, and dihydroxysilicon phthalocyanine dimer.

The oxotitanyl phthalocyanine may include α-type oxotitanyl phthalocyanine, β-type oxotitanyl phthalocyanine, γ-type oxotitanyl phthalocyanine, m-type oxotitanyl phthalocyanine, Y-type oxotitanyl phthalocyanine, A-type oxotitanyl phthalocyanine, B-type oxotitanyl phthalocyanine, and oxotitanyl phthalocyanine amorphous.

These phthalocyanine compounds may be prepared by a conventional method. For example, the oxotitanyl phthalocyanine may be produced in accordance with a method described in Japanese Patent Application Laid-Open No. 189873/1992 (JP-4-189873A), Japanese Patent Application Laid-Open No. 43813/1993 (JP-5-43813A), or others. Moreover, the crystal structure of the oxotitanyl phthalocyanine may be controlled by a method such as an acid pasting or a salt milling.

The chlorogallium phthalocyanine may be, for example, produced by a method described in Japanese Patent Application Laid-Open No. 98181/1993 (JP-5-98181A). The chlorogallium phthalocyanine may be dry milled by using a means such as an automatic mortar, a planet mill, a vibrating mill, a CF mill, a roller mill, a sand mill or a kneader, or may be subjected to wet milling with a solvent by using a means such as a ball mill, a mortar, a sand mill or a kneader after dry milling.

The hydroxygallium phthalocyanine may be prepared by a method comprising hydrolyzing, in an acidic or alkaline solution, a chlorogallium phthalocyanine crystal obtained by a method described in Japanese Patent Application Laid-Open No. 263007/1993 (JP-5-263007A), Japanese Patent Application Laid-Open No. 279591/1993 (JP-5-279591A) or others, or a method comprising acid pasting, and others. The hydroxygallium phthalocyanine may be subjected to wet milling with a solvent by using a means such as a ball mill, a mortar, a sand mill or a kneader, or may be treated with a solvent after dry milling without using a solvent.

These phthalocyanine compounds may be used, by mixing or milling, as a mixture obtained, or as a mixed crystal system newly formed.

The mixed crystal system may include, for example, a mixed crystal of oxotitanyl phthalocyanine and vanadyl phthalocyanine, described in Japanese Patent Application Laid-Open No. 371962/1992 (JP-4-371962A), Japanese Patent Application Laid-Open No. 2278/1993 (JP-5-2278A), Japanese Patent Application Laid-Open No. 2279/1993 (JP-5-2279A) or others, and a mixed crystal of oxotitanyl phthalocyanine and chloroindium phthalocyanine, described in Japanese Patent Application Laid-Open No. 148917/1994 (JP-6-148917A), Japanese Patent Application Laid-Open No. 145550/1994 (JP-6-145550A), Japanese Patent Application Laid-Open No. 271786/1994 (JP-6-271786A), Japanese Patent Application Laid-Open No. 297617/1993 (JP-5-297617A) or others.

Examples of other preferred charge-generating agent may include an azo-series pigment such as a bisazo pigment or a trisazo pigment. Among the azo-series pigments, a compound represented by the following formula is particularly preferred.

[Bisazo compound]

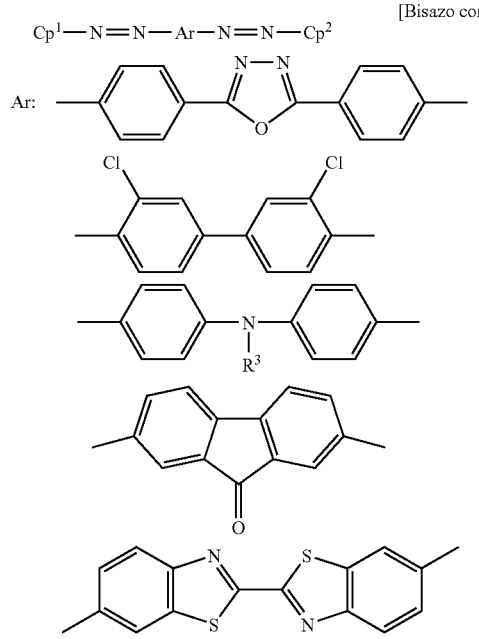

In the formula, $R^3$ represents a lower alkyl group.

[Trisazo compound]

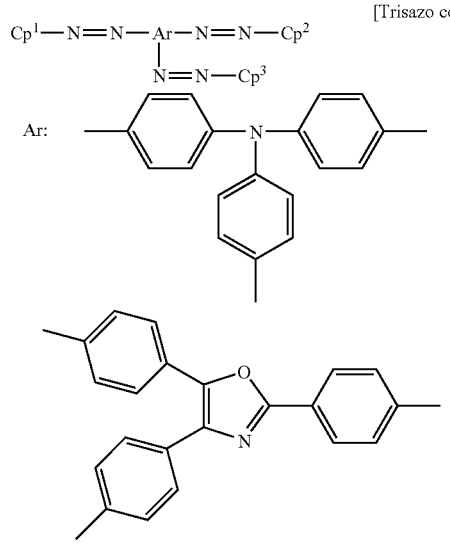

Incidentally, $Cp^1$ and $Cp^2$ in the bisazo compound, and $Cp^1$, $Cp^2$ and $Cp^3$ in the trisazo compound are each selected from the following groups.

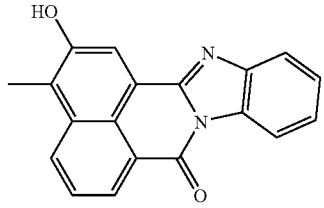

-continued

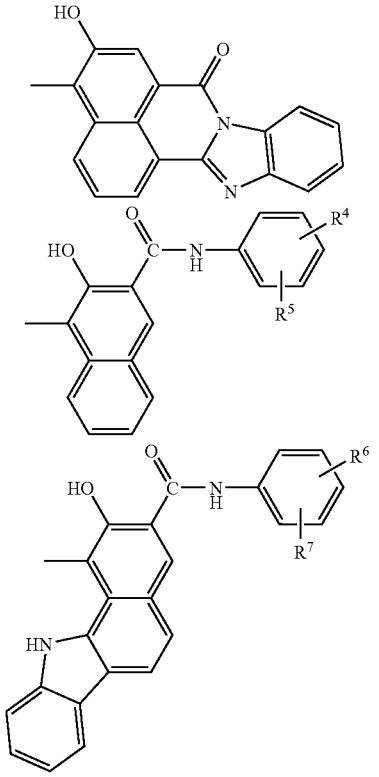

In the formula, $R^4$, $R^5$, $R^6$ and $R^7$ are the same or different from each other and each represents a hydrogen atom, a halogen atom or a lower alkyl group.

Incidentally, examples of the lower alkyl group may include a linear or branched $C_{1-6}$alkyl group such as methyl, ethyl, propyl, isopropyl, butyl or t-butyl group (in particular a $C_{1-4}$alkyl group). The halogen atom includes a fluorine, a chlorine, a bromine or an iodine atom.

The binder resin usable for the charge-generating layer may include a thermoplastic resin such as an olefinic resin (e.g., a polyethylene), a vinyl-series resin (e.g., a polyvinyl chloride, a polyvinylidene chloride, a polyvinyl acetate, and a vinyl chloride-vinyl acetate copolymer), a styrenic resin (e.g., a polystyrene), a (meth)acrylic resin [e.g., a poly (methyl methacrylate), a (meth)acrylic acid-(meth)acrylate copolymer, a (meth)acrylic acid-(meth)acrylate-(meth) acrylic acid copolymer, and a polyacrylamide], a polyamide-series resin (e.g., a polyamide 6, and a polyamide 66), a polyester-series resin (e.g., a polyalkylene arylate such as a polyethylene terephthalate or a polybutylene terephthalate, or a copolyester thereof), a polycarbonate-series resin (e.g., a bisphenol A-based polycarbonate), a polyurethane-series resin, a polyketone-series resin (e.g., a polyketone, and a polyvinyl ketone), a polyvinyl acetal-series resin (e.g., a polyvinyl formal, and a polyvinyl butyral), or a heterocycle-containing resin (e.g., a poly-N-vinylcarbazole); a thermosetting resin such as a phenol resin, a silicone resin, an epoxy resin (e.g., a bisphenol-based epoxy resin), or a vinyl ester-series resin such as an epoxy(meth)acrylate; and others. These binder resins may be used singly or in combination.

Among these binder resins, a low water-absorbing resin, for example, a polycarbonate-series resin, a polyvinyl acetal-series resin (e.g., apolyvinyl butyral), a polyester-series resin, or the like, is preferred.

As the polycarbonate-series resin, for example, there may be used a polycarbonate obtained by a phosgene method which comprises allowing a bisphenol compound to react with phosgene; a transesterification method which comprises allowing a bisphenol compound to react with a carbonic acid diester; or other method. As the bisphenol compound, for example, there may be mentioned the following compounds:

a biarenediol, for example, biphenyl-4,4'-diol, and bi-2-naphtharene-1,1'-diol, a bis(hydroxyaryl)$C_{1-6}$alkane, for example, bis(4-hydroxyphenyl)methane (bisphenol F), 1,1-bis(4-hydroxyphenyl) ethane (bisphenol AD), and 2,2-bis(4-hydroxyphenyl)propane (bisphenol A);

a bis(hydroxyaryl)$C_{1-6}$alkane having, in the arene ring thereof, at least one substituent selected from a $C_{1-6}$alkyl group, a $C_{2-6}$alkenyl group, a $C_{5-8}$cycloalkyl group, a halogen atom, and the like, for example, bis(2-hydroxy-3-t-butyl-5-methylphenyl)methane, bis(2-hydroxy-3-t-butyl-5-ethylphenyl)methane, 2,2-bis(4-hydroxy-3-methylphenyl) propane (bisphenol C), 2,2-bis(4-hydroxy-3,5-dimethylphenyl)propane, 2,2-bis(4-hydroxy-3-t-butylphenyl)propane, 1,1-bis(4-hydroxy-3-t-butyl-6-methylphenyl)butane, 2,2-bis(4-hydroxy-3-allylphenyl) propane, 2,2-bis(3-cyclohexyl-4-hydroxyphenyl)propane, 2,2-bis(4-hydroxy-3,5-dibromophenyl)propane, 2,2-bis(4-hydroxy-3,5-dichlorophenyl)propane, 2,2-bis(4-hydroxy-3-bromophenyl)propane, and 2,2-bis(4-hydroxy-3-chlorophenyl)propane;

a bisphenol compound which may have a substituent in an alkane of a bis(hydroxyaryl)alkane, for example, 1,1-bis(4-hydroxyphenyl)-1-phenylethane (bisphenol AP), bis(4-hydroxyphenyl)diphenylmethane, and 2,2-bis(4-hydroxyphenyl)hexafluoropropane;

a ring assembly bisphenol compound, for example, 1,4-bis(1-methyl-1-(4-hydroxyphenyl)ethyl)benzene, and 1,3-bis(1-methyl-1-(4-hydroxyphenyl)ethyl)benzene;

a bisphenol compound having a condensed polycyclic hydrocarbon ring, for example, 6,6'-dihydroxy-3,3,3',3'-tetramethyl-1,1'-spirobiindane, 1,1,3-trimethyl-3-(4-hydroxyphenyl)-indan-5-ol, and 6,6'-dihydroxy-4,4,4',4'7,7'-hexamethyl-2,2'-spirobichromane;

a silicon-containing bisphenol compound, for example, α,ω-bis[3-(o-hydroxyphenyl)propyl]polydimethylsiloxane, α,ω)-bis[3-(o-hydroxyphenyl)propyl]polydimethyldiphenylsiloxane, α,ω-bis[3-(4-hydroxy-3-alkoxyphenyl)propyl] polydimethylsiloxane, α,ω-bis[2-methyl-2-(4-hydroxyphenyl)ethyl]polydimethylsiloxane, bis(4-hydroxyphenyl) dimethylsilane, bis(4-hydroxyphenyl)polydimethylsilane, and bis(4-hydroxyphenyl)polydiphenylsilane;

a bis(hydroxyaryl)$C_{4-10}$cycloalkane which may have a substituent, for example, 1,1-bis(4-hydroxyphenyl)cyclohexane, 3,3,5-trimethyl-1,1-bis(4-hydroxyphenyl)cyclohexane, and 1,1-bis(3-methyl-4-hydroxyphenyl)cyclohexane;

a bis(hydroxyaryl)sulfone such as bis(4-hydroxyphenyl) sulfone, bis(4-hydroxyphenyl)ether, bis(4-hydroxyphenyl) sulfoxide, bis(4-hydroxyphenyl) sulfide, bis(4-hydroxyphenyl) ketone, and bis(2-methyl-4-hydroxy-5-t-butylphenyl) sulfide;

a bisphenol compound having a heterocycle, for example, 2,2'-methylenebis[4-(1,1,3,3-tetramethylbutyl)-6-(2H-benzotriazol-2-yl)phenol], 4,4'-hexamethylenediethoxycarbonylbis[2-t-butyl-6-(2H-benzotriazol-2-yl)phenol], 2,2'-methylenebis[4-methyl-6-(2H-benzotriazol-2-yl)phenol]; and triethylene glycolbis[3-(3-t-butyl-4-hydroxy-5-methylphenyl)propionate], 3,9-bis[2-{(3-(3-t-butyl-4-hydroxy-5-methylphenyl)propionioxy}-1,1-dimethylethyl]-2,4,8,10-tetraoxaspiro[5.5]undecane, 4-methyl-2,4-bis(4-hydroxyphenyl)-1-heptene, and a bisphenol compound having a fluorene backbone.

The above-mentioned bisphenol having a fluorene backbone may include, for example, 9,9-bis(4-hydroxyphenyl) fluorene or a 9,9-bis(alkylhydroxyphenyl)fluorene such as 9,9-bis(4-hydroxy-3-methylphenyl)fluorene; a 9,9-bis(arylhydroxyphenyl)fluorene such as 9,9-bis(4-hydroxy-3-phenylphenyl)fluorene; and a 9,9-bis[4-(2-hydroxy(poly) alkoxy)phenyl]fluorene such as 9,9-bis(4-(2-hydroxyethoxy)phenyl)fluorene.

The proportion of the charge-generating agent may be suitably determined depending on the species of the charge-generating agent, or the like. The proportion of the charge-generating agent is usually about 10 to 1000 parts by weight, preferably about 30 to 600 parts by weight, and more preferably about 50 to 300 parts by weight, relative to 100 parts by weight of the binder resin.

Incidentally, if necessary, the charge-generating layer may comprise the after-mentioned charge-transporting agent.

The thickness of the charge-generating layer is, for example, about 0.01 to 10 μm (e.g., about 0.01 to 5 μm), preferably about 0.05 to 2 μm, and usually about 0.1 to 5 μm.

The method for forming the charge-generating layer may be classified broadly into two categories: one is a method of forming a thin coat of a charge-generating agent by a vacuum deposition method; and the other is a method of coating a liquid coating composition (solution or dispersion liquid) containing a charge-generating agent (if necessary, and a binder resin). The vacuum deposition method may include a vapor deposition method, a sputtering method, a reactive sputtering method, a CVD method, a glow discharge decomposition method, an ion plating method, and others.

The above-mentioned coating method may include a conventional method, for example, a dip method, a spin coating method, a spray coating method, a screen printing method, a cast method, a bar coating method, a curtain coating method, a roll coating method, a gravure coating method, a bead coating method, and others.

In the above-mentioned coating method, the liquid coating composition may be prepared by dissolving or dispersing the above-mentioned charge-generating agent (and the above-mentioned binder resin) in a solvent. The solvent is not particularly limited to a specific one, and may be selected depending on components constituting the charge-generating layer. As the solvent, there may be mentioned a conventional solvent, for example, an ether (e.g., diethyl ether, tetrahydrofuran, and dioxane), a ketone (e.g., butanone, and cyclohexanone), an ester (e.g., methyl acetate, and ethyl acetate), a halogenated hydrocarbon (e.g., dichloromethane, dichloroethane, and monochlorobenzene), a hydrocarbon (e.g., hexane, toluene, and xylene), water, an alcohol (e.g., methanol, and ethanol), and others.

Incidentally, the liquid coating composition may be prepared by dispersing or mixing a charge-generating agent, a binder resin and a solvent by using a mixer (for example, a ball mill, an atritor (pulverizing mill), and a sand mill).

Moreover, after formation of a coat (charge-generating layer), the coat may be subjected to a dry treatment. The dry treatment may be conducted under any condition of an atmospheric pressure, an applied pressure or a reduced pressure, or may be conducted at an ordinary temperature or under heating.

(Charge-transporting Layer)

In the laminated photosensitive layer, the charge-transporting layer may comprise a charge-transporting agent alone, and usually comprises a charge-transporting agent and a binder resin.

The charge-transporting agent may be divided broadly into two groups of a hole transport material and an electron transport material. The charge-transporting agent may be used singly or in combination.

The hole transport material may include, for example, a hole transport material having a low molecular weight such as an oxazole derivative, a oxadiazole derivative, a imidazole derivative, a styrylanthracene, a styrylpyrazoline, a phenylhydrazone, a triphenylmethane derivative, a triphenylamine derivative, a phenylenediamine derivative, an N-phenylcarbazole derivative, a stilbene derivative, a thiazole derivative, a triazole derivative, a phenazine derivative, an acridine derivative, a benzofuran derivative, a benzimidazole derivative, or a thiophene derivative; and a hole transport material having a high molecular weight such as a poly-N-vinylcarbazole, a polystyrylanthracene, a polyester carbonate, or a high molecular weight polysilane (e.g., a polysilane having a number-average molecular weight of not less than 3000) such as a linear polysilane.

As the hole transport material having a low molecular weight, for example, a diamine compound represented by the following formula (A) is preferably used.

(A)

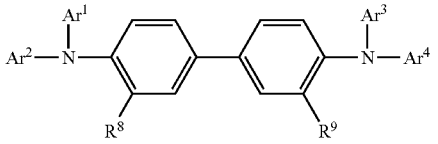

In the formula, $R^8$ and $R^9$ are the same or different from each other and each represents a hydrogen atom, a halogen atom, a lower alkyl group, a lower alkoxy group, or an aryl group; and $Ar^1$, $Ar^2$, $Ar^3$ and $Ar^4$ are the same or different from each other and each represents an aryl group which may have a substituent.

Incidentally, the halogen atom includes, a fluorine, a chlorine, a bromine, or an iodine atom. Examples of the lower alkyl group may include a linear or branched $C_{1-6}$alkyl group such as methyl, ethyl, propyl, isopropyl, butyl, or t-butyl group (in particular a $C_{1-4}$alkyl group). The lower alkoxy group may include a linear or branched $C_{1-6}$alkoxy group such as methoxy, ethoxy, propoxy, butoxy, or t-butoxy group (in particular a $C_{1-4}$alkoxy group). As the aryl group, there may be mentioned a $C_{6-12}$aryl group such as phenyl group or a naphthyl group (α-naphthyl group, β-naphthyl group), and a biphenyl group (e.g., p-biphenyl group). The aryl group represented by $R^8$ and $R^9$ is often phenyl group. The aryl group represented by $Ar^1$, $Ar^2$, $Ar^3$ and $Ar^4$ may be phenyl group, a naphthyl group, a biphenyl group, and the like. The substituent of the aryl group may include the halogen atom, the lower alkyl group, the lower alkoxy group, and others.

Among these diamine compounds, diamine compounds represented by the following formulae (A-1), (A-2), and (A-3) are preferred.

(A-1)

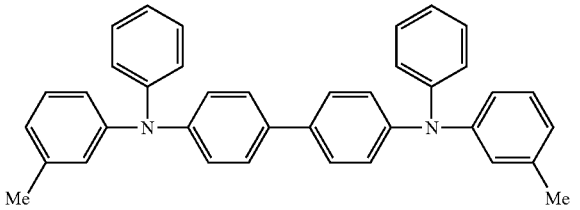

(A-2)

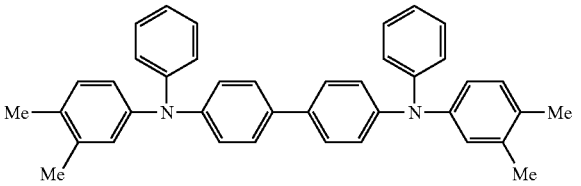

(A-3)

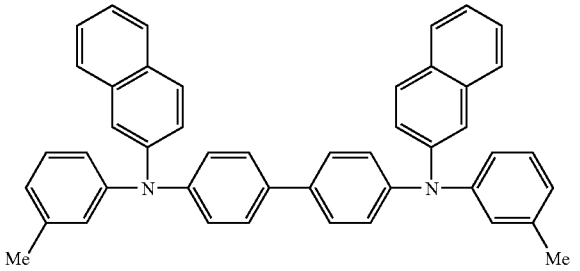

Further, examples of the hole transport material having a low molecular weight may include a hydrazone compound represented by the following formula (J) described in Japanese Patent Publication No. 42380/1980 (JP-55-42380B), Japanese Patent Application Laid-Open No. 340999/1985 (JP-60-340999A), Japanese Patent Application Laid-Open No. 23154/1986 (JP-61-23154A), or others; a distyryl-series compound represented by the following formula (K) described in U.S. Pat. No. 3,873,312, or others; and, in addition, a triarylamine derivative such as a triphenylmethane derivative, an N,N-diphenyl-N-biphenylamine derivative or an N,N-diphenyl-N-terphenylamine derivative, 1-(p-aminophenyl)-1,4,4-triphenylbutadiene derivative described in Japanese Patent Application Laid-Open No. 288110/1999 (JP-11-288110A), other tetraphenylbutadiene-series compound, an α-phenylstilbene derivative, or a bisbutadienyltriphenylamine derivative described in Japanese Patent Application Laid-Open No. 173112/1985 (JP-7-173112A); and others. Incidentally, the usable hole transport material having a low molecular weight is not limited to these compounds.

(J)

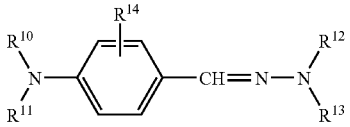

In the formula, $R^{10}$ and $R^{11}$ are the same or different from each other and each represents a lower alkyl group which may have a substituent, an aryl group which may have a substituent, or an aralkyl group which may have a substituent; $R^{12}$ and $R^{13}$ are the same or different from each other and each represents a lower alkyl group which may have a substituent, an aryl group which may have a substituent, an aralkyl group which may have a substituent, or a heterocycle group which may have a substituent; $R^{12}$ and $R^{13}$ may bond to each other to form a ring; $R^{14}$ represents a hydrogen atom, a lower alkyl group which may have a substituent, an aryl group which may have a substituent, an aralkyl group which may have a substituent, a lower alkoxy group which may have a substituent, or a halogen atom; and $R^{14}$ and $R^{10}$ or $R^{11}$ may bond to each other to form a ring.

(K)

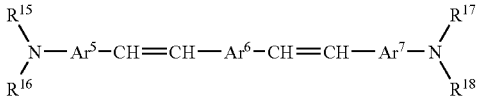

In the formula, $R^{15}$, $R^{16}$, $R^{17}$ and $R^{18}$ are the same or different from each other and each represents a lower alkyl group, or an aryl group which may have a substituent; $Ar^5$ and $Ar^7$ are the same or different from each other and each represents a phenyl group which may have as a substituent one or more group(s) selected from the group consisting of a lower alkyl group, a lower alkoxy group, an aryloxy group and a halogen atom; and $Ar^6$ represents a monocyclic or polycyclic $C_{4-14}$hydrocarbon ring which may have a substituent similar to that of $Ar^5$ and $Ar^7$ (e.g., an aromatic hydrocarbon ring such as benzene ring), or a heterocycle which may have a substituent similar to that of $Ar^5$ and $Ar^7$.

Examples of the lower alkyl group, the lower alkoxy group, and the aryl group may include the groups as mentioned above. As the aralkyl group, there may be mentioned a $C_{6-10}$aryl-$C_{1-4}$alkyl group such as benzyl group. The aryloxy group may include a $C_{6-10}$ aryloxy group such as phenoxy group. Examples of the heterocycle group (or heterocycle) may include a five- or six-membered heterocycle group (or heterocycle) containing as a constituent atom of the ring at least one hetero atom selected from the group consisting of nitrogen atom, oxygen atom and sulfur atom; and a condensed heterocycle group (or condensed heterocycle) of the five- or six-membered heterocycle and an arene ring (e.g., benzene ring). Examples of the substituent may include a halogen atom, a $C_{1-4}$alkyl group, a hydroxyl group, a $C_{1-4}$alkoxy group, a carboxyl group, an alkoxycarbonyl group, and an acyl group. The rings formed by a linkage between $R^{10}$ and $R^{11}$, a linkage between $R^{12}$ and $R^{13}$, and a linkage between $R^{14}$ and $R^{10}$ or $R^{11}$ may be a three- to ten-membered ring.

The electron transport material may include, for example, a Schiff base compound (e.g., a halogen-containing Schiff base such as chloroanyl or bromoanyl), a cyano group-containing compound (e.g., tetracyanoethylene, and tetracyanoquinodimethane), a nitro group-containing compound (e.g., a fluorenone compound such as 2,4,7-trinitro-9-fluorenone, or 2,4,5,7-tetranitro-9-fluorenone; a thioxanthone compound such as 2,4,5,7-tetranitroxanthone or 2,4,8-trinitrothioxanthone; a thiophene compound such as 2,6,8-trinitro-4H-indeno[1,2-b]thiophen-4-one or 1,3,7-trinitrodibenzothiophene-5,5-dioxide), and others.

As a binder resin of the charge-transporting layer, there may be used a binder resin exemplified in the section on the charge-generating layer, or other resins. Incidentally, since the charge-transporting layer is often formed on the charge-generating layer, among the above-exemplified resins, it is preferred to use, as a binder resin, a resin having a high mechanical strength or chemical stability together with a high transparency, for example, a polycarbonate-series resin, a polyester-series resin, and others (in particular a polycarbonate-series resin).

The proportion of the charge-transporting agent may be suitably selected, and for example, is about 10 to 300 parts by weight, preferably about 20 to 200 parts by weight, and more preferably about 30 to 150 parts by weight relative to 100 parts by weight of the binder resin.

The thickness of the charge-transporting layer is about 3 to 100 μm, preferably about 5 to 50 μm, and more preferably about 8 to 30 μm. Moreover, in the case where the charge-transporting layer is formed from a plurality of layers, the thickness of a top surface layer thereof (or the top surface layer of the electrophotographic photosensitive element) may be, for example, about 0.3 to 50 μm, preferably about 0.5 to 30 μm, and more preferably about 1 to 20 μm. Incidentally, the thickness of the charge-transporting layer may be larger than that of the charge-generating layer.

The charge-transporting layer may be formed in the same method as the coating method described in the section on the charge-generating layer.

(Single-layered Photosensitive Layer)

The single-layered photosensitive layer contains a charge-generating agent, a charge-transporting agent, and a binder resin in the single layer. Incidentally, as these components, there may be used the charge-generating agent, the charge-transporting agent and the binder resin, mentioned above, respectively.

In the single-layered photosensitive layer, the proportion of the charge-generating agent is about 1 to 60 parts by weight, preferably about 2 to 50 parts by weight, and more preferably about 3 to 40 parts by weight, relative to 100 parts by weight of the binder resin. Moreover, the proportion of the charge-transporting agent may be about 30 to 150 parts by weight, preferably about 30 to 120 parts by weight, and more preferably about 30 to 100 parts by weight, relative to 100 parts by weight of the binder resin.

The thickness of the single-layered photosensitive layer is usually about 3 to 100 μm, preferably about 5 to 50 μm, and more preferably about 8 to 30 μm. Moreover, in the case where the single-layered photosensitive layer is formed from a plurality of layers, the thickness of a top surface layer thereof (or the top surface layer of the electrophotographic photosensitive element) may be, for example, about 0.3 to 50 μm, preferably about 0.5 to 30 μm, and more preferably about 1 to 20 μm.

The single-layered photosensitive layer may be formed by using a liquid coating composition comprising the charge-generating agent, the charge-transporting agent and the binder resin in the same method as the coating method described in the section on the charge-generating layer.

Incidentally, the photosensitive layer (the single-layered photosensitive layer, the charge-generating layer or the charge-transporting layer) may comprise various additives, for example, a plasticizer (e.g., a biphenyl-series compound, m-terphenyl, m-di-t-butylphenyl, and dibutylphthalate), a stabilizer (e.g., an antioxidant, and an ultraviolet ray absorbing agent), a leveling agent, a lubricant (e.g., a surface lubricant such as a silicone oil, a graft silicone polymer, or a fluorocarbon), a potential stabilizer (e.g., a dicyanovinyl compound, and a carbazole derivative), and a light stabilizer (e.g., a hindered amine-series light stabilizer such as bis(2,2,6,6-tetramethyl-4-piperidyl) sebacate), in order to improve a film-forming property, plasticity, coating property, durability, and others.

(Surface Protection Layer)

The electrophotographic photosensitive element of the present invention may have a surface protection layer on the photosensitive layer (in the case of the laminated photosensitive layer, the charge-generating layer or the charge-transporting layer) for protecting the surface thereof regardless of single-layered type or laminated type. The surface protection layer may be a single layer or may comprise a plurality of layers (e.g., two to five layers). Incidentally, the whole surface protection layer may constitute the top surface layer. When the surface protection layer comprises a plurality of layers, a layer located on the top surface side in the protection layer may constitute the top surface layer.

The surface protection layer may comprise a binding agent (or a binding composition) such as a binder resin (e.g., a binder resin as exemplified above), a thermosetting resin (or a photo-curing resin), a hydrolyzed condensate of a polyfunctional organic silicon compound having a hydroxyl group, a plurality of hydrolyzable groups (such as an alkoxy group) or other groups, or the like. Moreover, the surface protection layer may comprise an electroconductive powder (or a mixture thereof) such as a metal oxide (tin oxide, indium oxide, indium-tin-oxide (ITO), titanium oxide) for imparting conductivity or hardness, and a charge-transporting agent (e.g., a charge-transporting agent as exemplified above), or may comprise a lubricant such as a polytetrafluoroethylene particle.

The thickness of the surface protection layer may be selected within the range that image deterioration is inhibited as much as possible. For example, the thickness is about 0.01 to 10 μm (e.g., about 0.01 to 5 μm), preferably about 0.05 to 2 μm, and usually 0.1 to 5 μm.

The surface protection layer may be formed by coating a coating composition in the same manner as the coating method described in the section on the charge-generating layer, and then drying or hardening the resultant coat.

Incidentally, in the electrophotographic photosensitive element, when a layer (e.g., a single-layered photosensitive layer, and a charge-transporting layer) is formed by the foregoing coating method, the species of a solvent to be used is not particularly limited to a specific one. It is preferred to use a solvent that does not significantly erode or dissolve a layer to be coated or an under layer (or a binder resin constituting an under layer).

As described above, in the electrophotographic photosensitive element of the present invention, at least the top surface layer contains a polysilane. In the top surface layer, the concentration of the polysilane may be uniform, or may have a gradient. For example, the concentration of the polysilane may gradually or successively decline from the surface side thereof. The content form of the polysilane is not particularly limited to a specific one, and for example, includes modes as described in FIGS. 1 to 3.

FIG. 1 is a schematic sectional view of a photosensitive element for showing an embodiment of the content form of the polysilane. In this embodiment, the polysilane is uniformly contained in a single-layered photosensitive layer 2 formed on an electroconductive support 1.

Figure 2:
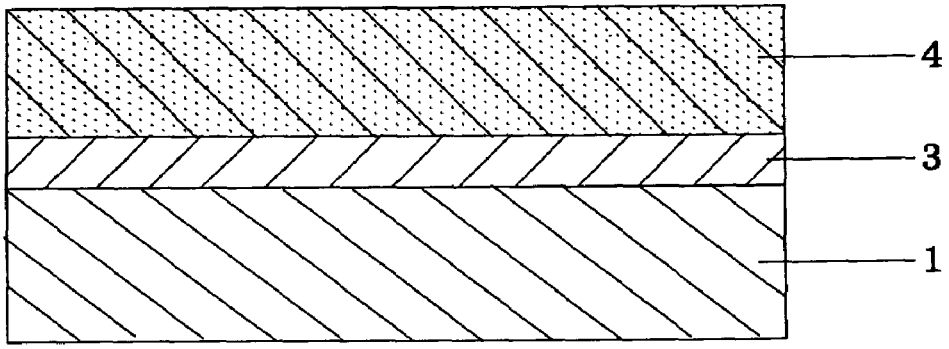
FIG. 2 is a schematic sectional view showing another embodiment of a form of a polysilane contained in a top surface layer.

FIG. 2 is a schematic sectional view of a photosensitive element for showing another embodiment of the content form of the polysilane. In this embodiment, a charge-generating layer 3 and a charge-transporting layer 4 are formed on an electroconductive support 1, and the polysilane is uniformly contained in the charge-transporting layer 4.

Figure 3:
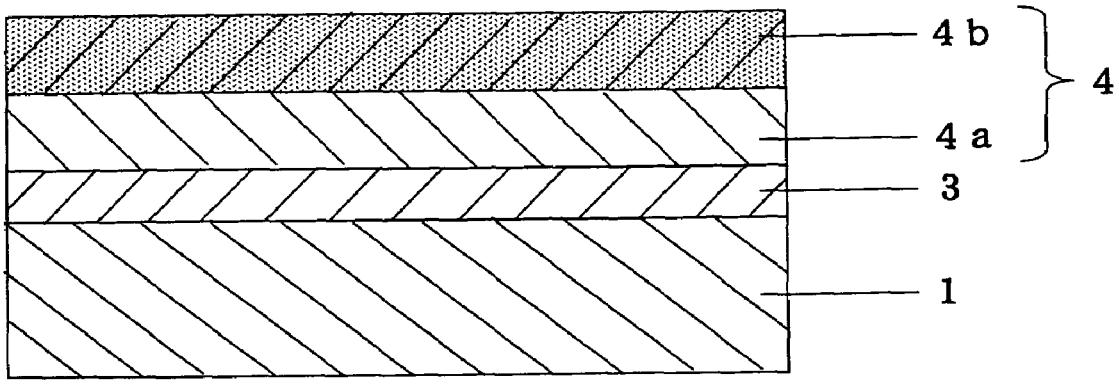
FIG. 3 is a schematic sectional view showing still another embodiment of a form of a polysilane contained in a top surface layer.

FIG. 3 is a schematic sectional view of a photosensitive element for showing still another embodiment of the content form of the polysilane. In this embodiment, a charge-generating layer 3 and a charge-transporting layer 4 are formed on an electroconductive support 1, and the charge-transporting layer 4 comprises a polysilane-free layer 4*a* and a top surface layer 4*b* uniformly containing the polysilane.

(Polysilane)

The polysilane may be a cyclic, linear, branched or mesh (or cancellous) compound having a Si—Si bond. As the polysilane, a cyclic polysilane represented by the above formula (1) may be usually employed.

(1)

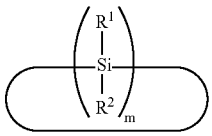

In the above formula (1), examples of the substituent represented by the $R^1$ and $R^2$ may include a hydrogen atom, a hydroxyl group, an alkyl group, an alkoxy group, an alkenyl group, a cycloalkyl group, a cycloalkyloxy group, a cycloalkenyl group, an aryl group, an aryloxy group, an aralkyl group, an aralkyloxy group, a silyl group, and others. The substituent is often a hydrocarbon group such as an alkyl group, an alkenyl group, a cycloalkyl group, an aryl group, or an aralkyl group. Moreover, the substituent such as a hydrogen atom, a hydroxyl group, an alkoxy group or a silyl group is often in the terminal group of the polysilane.

The alkyl group may include a linear or branched $C_{1-14}$alkyl group such as methyl, ethyl, propyl, isopropyl, butyl, t-butyl or pentyl (preferably a $C_{1-10}$alkyl group, and more preferably a $C_{1-6}$alkyl group). The alkoxy group may include a linear or branched $C_{1-14}$alkoxy group such as methoxy, ethoxy, propoxy, isopropoxy, butoxy, t-butoxy or pentyloxy (preferably a $C_{1-10}$alkoxy group, and more preferably a $C_{1-6}$alkoxy group). Examples of the alkenyl group may include a $C_{2-14}$alkenyl group such as vinyl, allyl, butenyl or pentenyl (preferably a $C_{2-10}$alkenyl group, and more preferably a $C_{2-6}$alkenyl group).

The cycloalkyl group may include a $C_{5-14}$cycloalkyl group such as cyclopentyl, cyclohexyl or methylcyclohexyl (preferably a $C_{5-10}$cycloalkyl group, and more preferably a $C_{5-8}$cycloalkyl group). Examples of the cycloalkyloxy group may include a $C_{5-14}$cycloalkyloxy group such as cyclopentyloxy or cyclohexyloxy (preferably a $C_{5-10}$ cycloalkyloxy group, and more preferably a $C_{5-8}$ cycloalkyloxy group). The cycloalkenyl group may include a $C_{5-14}$cycloalkenyl group such as cyclopentenyl or cyclohexenyl (preferably a $C_{5-10}$cycloalkenyl group, and more preferably a $C_{5-8}$cycloalkenyl group).

The aryl group may include a $C_{6-20}$aryl group such as phenyl, methylphenyl (tolyl), dimethylphenyl (xylyl), or naphthyl (preferably a $C_{6-15}$aryl group, and more preferably a $C_{6-12}$aryl group). As the aryloxy group, there may be mentioned a $C_{6-20}$aryloxy group such as phenoxy or naphthyloxy (preferably a $C_{6-15}$aryloxy group, and more preferably a $C_{6-12}$aryloxy group). The aralkyl group may include a $C_{6-20}$aryl-$C_{1-4}$alkyl group such as benzyl, phenethyl or phenylpropyl (preferably a $C_{6-10}$aryl-$C_{1-2}$alkyl group). Examples of the aralkyloxy group may include a $C_{6-20}$aryl-$C_{1-4}$alkyloxy group such as benzyloxy, phenethyloxy or phenylpropyloxy (preferably a $C_{6-10}$ aryl-$C_{1-2}$alkyloxy group).

The silyl group may include a $Si_{1-10}$silyl group such as silyl group, disilanyl group, or trisilanyl group (preferably a $S_{1-6}$silyl group).

Moreover, in the case where the $R^1$ and $R^2$ are the above-mentioned organic substituent or silyl group, at least one hydrogen atom of the organic substituent or silyl group may be substituted with a functional group such as an alkyl group, an aryl group, or an alkoxy group. Such a functional group may include a group similar to the foregoing group.

Among these substituents, the alkyl group (e.g., a $C_{1-4}$alkyl group such as methyl group), the aryl group (e.g., a $C_{6-20}$aryl group such as phenyl group) or other group is generally used.

In the above formula (1), at least one of the groups, $R^1$ and $R^2$, is preferably an aryl group [in particular, a $C_{6-20}$aryl group (e.g., phenyl group)]. Such a polysilane includes, for example, a cyclic polysilane whose $R^1$ is an aryl group and $R^2$ is an alkyl group (in particular, a cyclic poly$C_{6-20}$aryl-$C_{1-4}$alkylsilane such as a cyclic polyphenylmethylsilane), a cyclic polysilane whose both $R^1$ and $R^2$ are aryl groups (in particular, a cyclic poly$C_{6-20}$arylsilane such as a cyclic polydiphenylsilane), and the like.

The number "m" of members constituting the ring of the cyclic polysilane is an integer of not less than 4, and is usually about 4 to 12, preferably about 4 to 10 (e.g., about 4 to 8), and more preferably about 5 to 10 (e.g., about 5 to 8). The number "m" of members may be usually about 5.

The cyclic polysilane may be a copolysilane (a silane-series copolymer). Such a cyclic copolysilane is, for example, represented by the following formula (1a):

(1a)

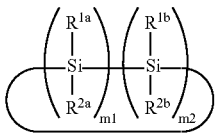

wherein $R^{1a}$ and $R^{2a}$ represents an aryl group which may have a substituent; $R^{1b}$ and $R^{2b}$ are the same or different from each other and each represents an alkyl group which may have a substituent, a cycloalkyl group which may have a substituent, or an aryl group which may have a substituent; provided that both $R^{1b}$ and $R^{2b}$ are not an aryl group which may have a substituent coincidentally; m1 denotes an integer of not less than 1; m2 denotes 0 or an integer of not less than 1; and m1+m2 denotes an integer of not less than 4.

Examples of the aryl group represented by $R^{1a}$, $R^{2a}$, $R^{1b}$ and $R^{2b}$ may include a $C_{6-20}$aryl group similar to the $R^1$ and $R^2$ (e.g., a $C_{6-15}$aryl group, preferably a $C_{6-12}$aryl group, and particularly a $C_{6-10}$aryl group). The substituent of the aryl group may include an alkyl group (a linear or branched $C_{1-10}$alkyl group such as methyl, ethyl, propyl, isopropyl, butyl, isobutyl or t-butyl group), a hydroxyl group, an alkoxy group (a linear or branched $C_{1-10}$alkoxy group such as methoxy, ethoxy, propoxy, butoxy or t-butoxy group), a carboxyl group, a linear or branched $C_{1-6}$alkoxy-carbonyl group, a linear or branched $C_{1-6}$alkyl-carbonyl group, and others. The preferred substituent of the aryl group includes a linear or branched alkyl group (preferably a $C_{1-6}$alkyl group, and particularly a $C_{1-4}$alkyl group), or a linear or branched alkoxy group (preferably a $C_{1-6}$alkoxy group, and particularly a $C_{1-4}$alkoxy group). The number of the substituent per the aryl group is not particularly limited to a specific one, and may be usually selected from the range of about 1 to 3. The preferred aryl group is a $C_{6-10}$aryl group [for example, phenyl group, and a $C_{1-4}$ alkylphenyl group (e.g., tolyl group, and xylyl group)], and is usually phenyl group.

Examples of the alkyl group represented by $R^{1b}$ and $R^{2b}$ may include a linear or branched $C_{1-14}$alkyl group similar to the above-mentioned $R^1$ and $R^2$ (e.g., a $C_{1-10}$alkyl group, preferably a $C_{1-6}$alkyl group, and particularly a $C_{1-4}$alkyl group). The cycloalkyl group may include a $C_{5-14}$cycloalkyl group similar to $R^1$ and $R^2$ mentioned above (e.g., a $C_{5-10}$cycloalkyl group, and preferably a $C_{5-8}$cycloalkyl group). Examples of the substituent of the alkyl group may include a hydroxyl group, a linear or branched $C_{1-4}$alkoxy group, a $C_{5-8}$cycloalkyl group, a $C_{6-10}$aryl group, a carboxyl group, a $C_{1-6}$alkoxycarbonyl group, a $C_{1-4}$alkyl-carbonyl group, a $C_{6-10}$aryl-carbonyl group, and others. The substituent of the cycloalkyl group may include, in addition to the substituent of the alkyl group, a linear or branched $C_{1-4}$alkyl group, and others. The number of the substituent is not particularly limited to a specific one, and may be usually selected from the range of about 1 to 3. The preferred $R^{1b}$ and $R^{2b}$ includes a $C_{1-4}$alkyl group (e.g., methyl group), a $C_{5-8}$cycloalkyl group (e.g., cyclohexyl group), a $C_{6-10}$aryl group (e.g., phenyl group), or a $C_{1-4}$alkyl-$C_{6-10}$aryl group (e.g., tolyl group, and xylyl group).

Incidentally, in the cyclic copolysilane, a combination of $R^{1b}$ and $R^{2b}$ may be various combinations as long as both $R^{1b}$ and $R^{2b}$ are not an aryl group which may have a substituent. Such a combination may include, for example, (1) a combination of an alkyl group (e.g., a linear or branched $C_{1-4}$alkyl group) and an alkyl group (e.g., a linear or branched $C_{1-4}$alkyl group), (2) a combination of an alkyl group (e.g., a linear or branched $C_{1-4}$alkyl group) and an aryl group (e.g., a $C_{6-10}$aryl group such as phenyl group), (3) a combination of an alkyl group (e.g., a linear or branched $C_{1-4}$alkyl group) and a cycloalkyl group (e.g., a $C_{5-8}$cycloalkyl group such as cyclohexyl group), or (4) a combination of an aryl group (e.g., a $C_{6-10}$aryl group such as phenyl group) and a cycloalkyl group (e.g., a $C_{5-8}$ cycloalkyl group such as cyclohexyl group). The preferred combination of $R^{1b}$ and $R^{2b}$ is the above-mentioned (2) or (3).

The number m1 is an integer of not less than 1 (e.g., about 1 to 10, preferably about 1 to 8, and particularly about 1 to 6), the number m2 is 0 or an integer of not less than 1 (e.g., about 0 to 10, preferably about 0 to 8, and particular about 0 to 6). Moreover, m1+m2 is an integer of not less than 4 (e.g., about 4 to 12, preferably about 4 to 10, more preferably about 5 to 10), usually about 4 to 8 (e.g., about 5 to 8), and particularly about 5.

The number-average molecular weight of the polysilane is about 200 to 5000, preferably about 400 to 3000, and more preferably about 500 to 2000 (e.g., about 600 to 1500). Such a polysilane is disposed to enhance dispersibility or compatibility to a resin. In such a polysilane, the ratio of the weight-average molecular weight (Mw) relative to the number-average molecular weight (Mn) [Mw/Mn] may be about 1 to 2, and preferably about 1.1 to 1.5.

Further, it is not necessary that the polysilane is a single compound of the cyclic polysilane, and the polysilane may be a polysilane mixture containing the cyclic polysilane. The polysilane mixture may be a mixture of the cyclic polysilane (e.g., a mixture of the same series of cyclic polysilanes different from each other in the number of members, and a mixture of different series of cyclic polysilanes), or a mixture of the cyclic polysilane and a chain polysilane (a linear or branched polysilane). For example, as the polysilane, a cyclic diphenylpolysilane and a cyclic diphenylsilane-methylphenylsilane copolymer may be used in combination. Examples of the cyclic homopolysilane may include, in the formula (1), a diarylpolysilane whose $R^1$ and $R^2$ are an aryl group (e.g., a $C_{6-10}$aryl group such as phenyl group) (for example, a diphenylpolysilane), an alkylarylpolysilane whose $R^1$ is an alkyl group (e.g., a linear or branched $C_{1-4}$alkyl group) and $R^2$ is an aryl group (e.g., a $C_{6-10}$aryl group such as phenyl group), an alkylcycloalkylpolysilane whose $R^1$ is an alkyl group (e.g., a linear or branched $C_{1-4}$alkyl group) and $R^2$ is a cycloalkyl group (e.g., a $C_{5-8}$cycloalkyl group such as cyclohexyl group), a dialkylpolysilane whose $R^1$ and $R^2$ are an alkyl group, and a dicycloalkylpolysilane whose $R^1$ and $R^2$ are a cycloalkyl group (e.g., a $C_{5-8}$cycloalkyl group such as cyclohexyl group). Examples of the cyclic copolysilane may include a di$C_{6-10}$arylsilyl-($C_{1-4}$alkyl-$C_{6-10}$aryl)silyl copolymer, a di$C_{6-10}$arylsilyl-($C_{1-4}$alkyl-$C_{6-8}$cycloalkyl)silyl copolymer, and others. The content of the cyclic polysilane (cyclic co- or homopolysilane) represented by the formula (1) or (1a) is, relative to the total polysilane mixture, for example, not less than 40% by weight (e.g., about 40 to 100% by weight), preferably not less than 50% by weight (e.g., about 50 to 100% by weight), and more preferably not less than 60% by weight (e.g., about 60 to 100% by weight).

Further, the proportion of a pentameric cyclic polysilane (homo- or copolysilane) relative to the total polysilane mixture is, for example, not less than 20% by weight (e.g., about 20 to 100% by weight), preferably not less than 30% by weight (e.g., about 30 to 90% by weight), more preferably not less than 40% by weight (e.g., about 40 to 90% by weight).

(Method for Producing Polysilane)

The polysilane may be prepared by various known methods. Methods for producing these polysilanes may include, for example, using a silicon-containing monomer having a specific structure unit as a raw material, a method of condensation-polymerizing a halosilane along with dehalogenation with magnesium as a reducing agent ("magnesium reduction method", e.g., WO98/29476 publication), a method of condensation-polymerizing a halosilane along with dehalogenation in the presence of an alkali metal ["kipping method", e.g., J. Am. Chem. Soc., 110, 124 (1988), and Macromolecules, 23, 3423 (1990)], a method of condensation-polymerizing a halosilane along with dehalogenation by electrode reduction [e.g., J. Chem. Soc. Chem. Commun., 1161 (1990), and J. Chem. Soc. Chem. Commun., 897 (1992)], a method of condensation-polymerizing a hydrazine along with dehydrogenation in the presence of a metal catalyst (e.g., Japanese Patent Application Laid-Open No. 334551/1992 (JP-4-334551A)), a method of subjecting a disilene crosslinked with a biphenyl or the like to anionic polymerization (e.g., Macromolecules, 23, 4494 (1990)), a method of subjecting a cyclic silane to ring-opening polymerization, or other methods.

Among these methods, the magnesium reduction method is the most preferably used in the viewpoint of the purity or molecular weight distribution of the resulting polysilane, the excellent compatibility to a resin, the small content of sodium or chlorine, and the industrial property such as production cost or safety. Incidentally, water may be added to the resulting polysilane to generate a silanol group.

Incidentally, for example, cyclization occurs during a synthetic process of the linear polysilane, as a result, the cyclic polysilane may be obtained. Moreover, the cyclic polysilane may be obtained by intramolecular cyclization of the above-mentioned polysilane, for example, an intramolecular condensation in which both ends of the polysilane are self-condensed. The above-mentioned intramolecular condensation may include, for example, an intramolecular dehydrogenation, an intramolecular dehalogenation, an intramolecular dehydrohalogenation, and an intramolecular dehydration.

More specifically, the cyclic polysilane can be obtained by bringing at least a dihalosilane, and if necessary at least one halosilane selected from the group consisting of a trihalosilane, a tetrahalosilane and a monohalosilane into reaction. Examples of the halogen atom constituting the halosilane may include a fluorine, a chlorine, a bromine and an iodine atom, and the bromine atom or the chlorine atom (particularly the chlorine atom) is preferred.

Examples of the dihalosilane may include a compound whose $R^1$ and $R^2$ are an aryl group, for example, a diaryldihalosilane [e.g., a di$C_{6-10}$aryldihalosilane such as a diphenyldihalosilane, a di($C_{1-6}$alkyl$C_{6-10}$aryl) dihalosilane such as a ditolyldihalosilane, a $C_{6-10}$aryl-$C_{1-6}$alkyl$C_{6-10}$ aryldihalosilane such as a phenyltolyldihalosilane, and a di($C_{1-6}$alkoxy$C_{6-10}$aryl) dihalosilane such as a dimethoxyphenyldihalosilane]; a compound whose $R^1$ and $R^2$ are an alkyl group, for example, a dialkyldihalosilane (e.g., a di$C_{1-4}$alkyldihalosilane such as a dimethyldihalosilane); a compound whose $R^1$ is an alkyl group and $R^2$ is a cycloalkyl group, for example, an alkyl-cycloalkyldihalosilane (e.g., a $C_{1-4}$alkyl-$C_{5-8}$ cycloalkyldihalosilane such as a methylcyclohexyldihalosilane); a compound whose $R^1$ is an alkyl group and $R^2$ is an aryl group, for example, an alkyl-aryldihalosilane (e.g., a $C_{1-4}$alkyl-$C_{6-10}$ aryldihalosilane such as a methylphenyldihalosilane or a methyltolyldihalosilane); and others. The preferred dihalosilane includes a diaryldihalosilane (e.g., a diphenyldihalosilane, and a ditolyldihalosilane), an alkyl-aryldihalosilane (e.g., a methylphenyldihalosilane, and a methyltolyldihalosilane), and an alkyl-cycloalkyldihalosilane (e.g., a methylcyclohexyldihalosilane).

Examples of the trihalosilane may include a $C_{1-6}$alkyltrihalosilane (e.g., a methyltrichlorosilane), a $C_{6-10}$cycloalkyltrihalosilane (e.g., a cyclohexyltrihalosilane), and a $C_{6-10}$aryltrihalosilane (e.g., a phenyltrichlorosilane, and a tolyldichlorosilane). As the monohalosilane, there maybe mentioned, for example, a tri$C_{1-6}$alkylhalosilane, a tri$C_{5-10}$ cycloalkylhalosilane, a tri$C_{6-12}$arylhalosilane, a mono$C_{1-6}$ alkyldi$C_{5-10}$cycloalkylhalosilane, a mono$C_{1-6}$ alkyldi$C_{6-12}$ arylhalosilane, a di$C_{1-6}$alkylmono$C_{5-10}$ cycloalkylhalosilane, and a di$C_{1-6}$alkylmono$C_{6-12}$ arylhalosilane.

These halosilanes may be used singly or in combination, respectively. Among these halosilanes, at least a dihalosilane is used in many cases, and a dihalosilane and a trihalosilane may be used in a proportion of the former relative to the latter of about 100/0 to 40/60 (molar ratio), and preferably about 100/0 to 50/50 (molar ratio).

Moreover, among the dihalosilanes, a diaryldihalosilane and other dihalosilane (e.g., an alkyl-aryldihalosilane, and an alkyl-cycloalkyldihalosilane) may be used in combination in a proportion of the former relative to the latter of about 100/0 to 40/60 (molar ratio), and preferably about 100/0 to 50/50 (molar ratio).

The reaction of the halosilane is usually carried out in the presence of a solvent inert to the reaction (aprotic solvent). The solvent may include, for example, an ether, a carbonate, a nitrile, an amide, a sulfoxide, a halogenated hydrocarbon, an aromatic hydrocarbon, an aliphatic hydrocarbon, or others. These solvents may be used as a mixed solvent.

The reaction is usually conducted in the presence of a magnesium metal component. The magnesium metal component may be a magnesium metal as simple substance or a magnesium-series alloy (e.g., an alloy containing aluminum, zinc, a rare earth element, or others), a mixture containing the magnesium metal or alloy, and others.

Examples of the shape (or form) of the magnesium metal component may include a particulate form (e.g., a powder, and a granule), a ribbon-shaped form, a cut or shaved piece, a massive form, a rod-like form, and a plate form. In particular, a shape (or form) having a large surface area (e.g., a powder, a granule, a ribbon-shaped form, and a cut or shaved piece) is preferred. In the case where the magnesium metal component is a particulate form, the average particle size thereof is about 1 to 10000 μm, preferably about 10 to 5000 μm, and more preferably about 20 to 1000 μm.

The amount to be used of the magnesium metal component is usually, in terms of magnesium, about 1 to 20 equivalent, preferably about 1.1 to 14 equivalent, and more preferably 1.2 to 10 equivalent (e.g., about 1.2 to 5 equivalent), relative to the halogen constituting the halosilane. Moreover, the amount (mol) to be used of the magnesium metal component is usually, as magnesium, about 1 to 20 time(s), preferably about 1.1 to 14 times, and more preferably about 1.2 to 10 times (e.g., about 1.2 to 5 times) as large as that of the halosilane.

It is sufficient that the reaction is carried out in the presence of at least the magnesium metal component. In order to accelerate polymerization of the halosilane, it is advantageous that the reaction is conducted in the coexistence of the magnesium metal component and at least one member selected from the group consisting of a lithium compound and a metal halide, in particular in the coexistence of the magnesium metal component and both of a lithium compound and a metal halide.

As the lithium compound, there may be used a lithium halide (e.g., lithium chloride, lithium bromide, and lithium iodide), a salt of an inorganic acid (e.g., lithium nitrate, lithium carbonate, lithium hydrogen carbonate, lithium sulfate, lithium perchlorate, and lithium phosphate) and others. The preferred lithium compound includes a lithium halide (particularly lithium chloride). The proportion of the lithium compound is, relative to 100 parts by weight of the total amount of the halosilane(s), about 0.1 to 200 parts by weight, preferably about 1 to 150 parts by weight, more preferably about 5 to 100 parts by weight (e.g., about 5 to 75 parts by weight) and usually about 10 to 80 parts by weight.

Examples of the metal halide may include a polyvalent metal halide such as a halide (e.g., a chloride, a bromide, and an iodide) of a metal, for example, a transition metal (e.g., the metal of the Group 3A of the Periodic Table of Elements such as samarium, the metal of the Group 4A of the Periodic Table of Elements such as titanium, the metal of the Group 5A of the Periodic Table of Elements such as vanadium, the metal of the Group 8 of the Periodic Table of Elements such as iron, nickel, cobalt or palladium, the metal of the Group 1B of the Periodic Table of Elements such as copper, and the metal of the Group 2B of the Periodic Table of Elements such as zinc), the metal of the Group 3B of the Periodic Table of Elements (e.g., aluminum), or the metal of the Group 4B of the Periodic Table of Elements (e.g., tin). The valence of the metal constituting the metal halide is preferably 2 to 4, and particularly 2 or 3. The proportion of the metal halide is, relative to 100 parts by weight of the total amount of the halosilane(s), about 0.1 to 50 parts by weight, preferably about 1 to 30 parts by weight, and more preferably about 2 to 20 parts by weight.

The reaction may be conducted by putting a reaction component, a magnesium metal component and a solvent, and if necessary a lithium compound and/or a metal halide in an airtight reaction vessel, and stirring the mixture. The inside of the reaction vessel may be in a dry atmosphere, and is preferably in a dry atmosphere of an inactive gas (e.g., a nitrogen gas, a helium gas, and an argon gas). The reaction temperature is usually within the range from −20° C. to a boiling point of the solvent, preferably from about 0 to 80° C., and more preferably from about 20 to 70° C. The resulting polysilane may be purified by a conventional method, for example, a reprecipitation method using a good solvent and a poor solvent, an extraction method, and others.

Such a polysilane has a high affinity or compatibility to a resin (e.g., a polycarbonate-series resin), and even a small amount of the polysilane imparts a high water repellency and lubricating property (lubricity) to the resin. Moreover, dispersibility to a resin is high, for example in a coat layer, the polysilane can be uniformly dispersed in the thickness direction (in-depth) of the layer without segregation. Therefore, addition of the polysilane in at least the top surface layer of the photosensitive layer realizes conservation of a lubricity or cleaning property of the photosensitive layer at a high level without causing bleeding out even when the top surface layer part is worn away by friction or sliding. Moreover, a high transparency of the photosensitive layer (in particular a photosensitive layer containing a resin binder) realizes a high definition image in an electrophotographic photosensitive element, and keeps up a high quality and high definition image property for a long period without causing deterioration in definition (or fineness), such as blur of printed character. Further, a small amount to be added of the polysilane does not deteriorate a mechanical strength of the photosensitive element (in particular the photosensitive layer), if anything, enhances or improves a mechanical strength of the photosensitive element.

(Proportion of Polysilane)

The polysilane may be contained in at least the top surface layer of the electrophotographic photosensitive element. According to the present invention, even when the content of the polysilane is small, a high lubricity or cleaning property can be realized.

Incidentally, in the photosensitive element of the present invention, addition of a small amount of the polysilane to the photosensitive layer (or the top surface layer of the photosensitive layer) can improve or enhance a mechanical strength of the photosensitive element (or the photosensitive layer), and can improve abrasion resistance. Therefore, the surface protection layer is not necessarily provided.

The content of the polysilane may be selected from the range in which water repellency or lubricity, and transparency are not deteriorated, and may be about 0.01 to 10% by weight, preferably about 0.05 to 5% by weight, and more preferably about 0.08 to 3% by weight (e.g., about 0.1 to 2% by weight) relative to the whole components of the top surface layer. The proportion of the polysilane is often about 0.01 to 5% by weight relative to the whole components of the top surface layer, and even when the proportion of the polysilane is about 0.01 to 3% by weight (e.g., about 0.1 to 1.5% by weight, and particularly about 0.25 to 1.5% by weight) relative to the whole components of the top surface layer, the properties (or characteristics) of the photosensitive layer can be significantly improved. In order to reduce the amount to be used of the polysilane, a cyclic homo- or copolysilane having at least a diarylsilane unit (e.g., a diarylpolysilane, and a diaryldihalosilane-alkylaryldihalosilane copolymer) is advantageous.

Incidentally, in the case where the top surface layer comprises a binder resin, the proportion of the polysilane may be, for example, about 0.01 to 15 parts by weight (e.g., about 0.02 to 10 parts by weight), preferably about 0.05 to 8 parts by weight, and more preferably about 0.1 to 5 parts by weight (e.g., about 0.1 to 3 parts by weight), relative to 100 parts by weight of the binder resin.

Moreover, in the case where the top surface layer comprises the charge-transporting agent and/or the charge-generating agent (particularly the charge-transporting agent), the proportion of the polysilane may be about 0.01 to 20 parts by weight, preferably about 0.05 to 15 parts by weight, and more preferably about 0.1 to 10 parts by weight (e.g., about 0.1 to 5 parts by weight) relative to 100 parts by weight of the charge-transporting agent or charge-generating agent.

The method for allowing the photosensitive element to contain the polysilane is not particularly limited to specific one, and various methods are available. For example, in the case where the top surface layer is formed by coating a liquid coating composition, the polysilane may be added to a solvent together with other components (e.g., a binder resin, a charge-transporting agent, a charge-generating agent, and a binding agent) in preparation of the liquid coating composition, or may be precedently melt-kneaded with a binder resin in the preparation of a binder resin pellet.

The composition containing the polysilane significantly improves abrasion resistance, durability, and other properties of the photosensitive layer without deteriorating an electrostatic property, photosensitivity, and others. The present invention therefore includes an electrophotographic photosensitive element composition comprising a component for the outer surface layer of the photosensitive layer or a component for the surface protection layer of the photosensitive layer, and a cyclic polysilane. This composition may be, for example, prepared by mixing components constituting the single-layered photosensitive layer, the charge-generating layer, the charge-transporting layer or the surface protection layer. The composition may be a liquid coating composition or coating composition containing an organic solvent. The composition usually comprises at least one member selected from the group consisting of the charge-generating agent and the charge-transporting agent, a binder (e.g., a polycarbonate-series resin), and a cyclic polysilane, depending on the structure of the photosensitive layer, or others.

Moreover, the electrophotographic photosensitive element of the present invention can be produced by forming at least a photosensitive layer on an electroconductive support, and at least the top surface layer (e.g., a charge-transporting layer) of the photosensitive layer may comprise a polysilane. The method for forming a photosensitive layer on an electroconductive support is not particularly limited to a specific one, and may be a conventional method (e.g., a method of coating the foregoing liquid coating composition). For example, in the case of a laminated photosensitive layer of which the top surface layer is a charge-transporting layer, the electrophotographic photosensitive element may be formed by coating a liquid coating composition containing a charge-generating agent on an electroconductive support (or charge injection-blocking layer), and further coating a liquid coating composition containing a charge-transporting agent (and a polysilane) thereon. Moreover, in the case where the functional layer (e.g., the charge-transporting layer) comprises a plurality of layers, for example, coating compositions different from each other in concentration (e.g., including a combination of a polysilane-free liquid coating composition and a liquid coating composition containing a polysilane) may sequentially coated to form the functional layer.

[Electrophotographic Apparatus]

The electrophotographic photosensitive element of the present invention may be used as a constituent unit of an electrophotographic apparatus. The electrophotographic apparatus is provided with constituent units such as the foregoing electrophotographic photosensitive element, a charging means, an exposing means (aligner), a developing means, a transferring means, a cleaning means, and a fixing means.

Figure 4:
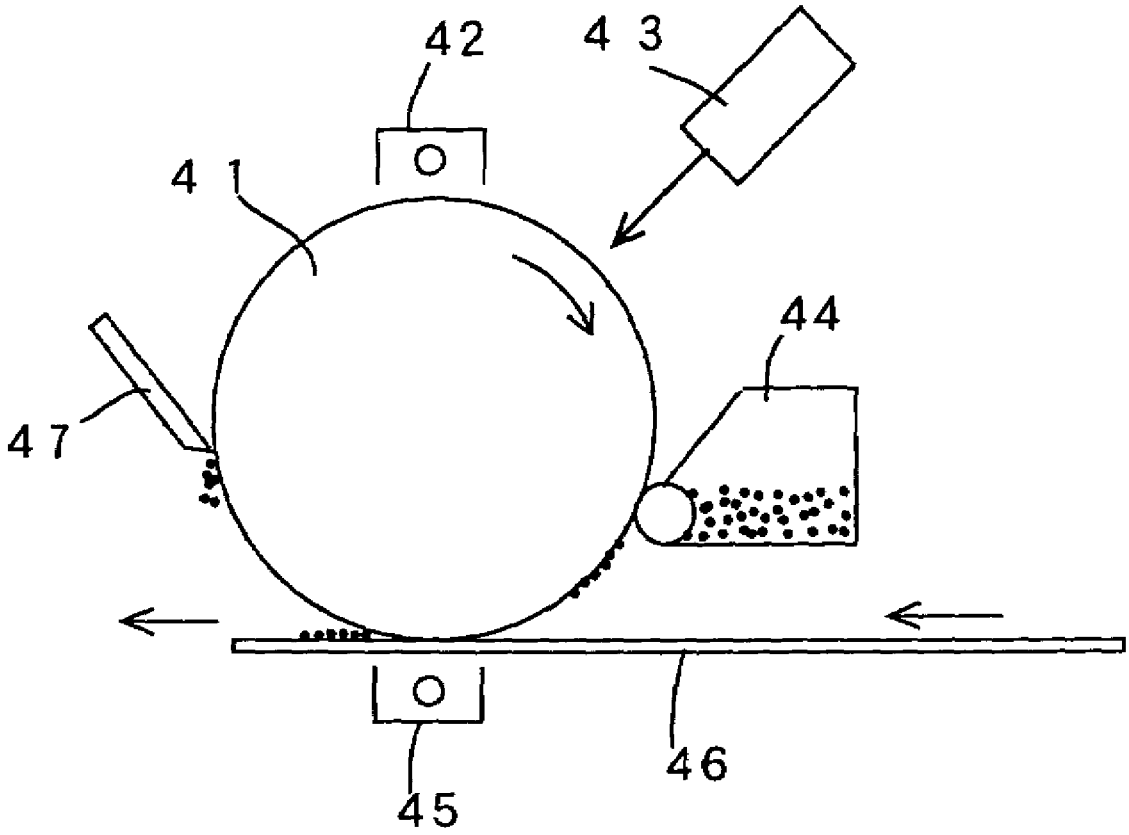
FIG. 4 is a schematic sectional view showing an embodiment of an electrophotographic apparatus provided with the electrophotographic photosensitive element of the present invention.

FIG. 4 is a schematic sectional view for showing an embodiment of an electrophotographic apparatus provided with the electrophotographic photosensitive element of the present invention. In FIG. 4, a rotatable electrophotographic photosensitive element 41 having a circular cylinder configuration in cross section is positively or negatively charged in a surface thereof by means of a charging means (charging unit) 42 equipped with a charging instrument (e.g., a corona discharging instrument), is subjected to exposure to a light of a light image by a light-exposing means (exposing unit) 43 equipped with a light source, thereby an electrostatic latent image corresponding to the light image on the surface of the photosensitive element is formed. The electrostatic latent image is developed by a toner of a developing means (developing unit) 44 equipped with a developing instrument, and a toner on the surface of the photosensitive element is transferred to an object 46 (such as a paper) by a transferring means (transferring unit) 45 equipped with a charging means. The object 46 on which the toner is transferred is fixed by a fixing means (not shown) to obtain a printed matter. The residual toner on the surface of the photosensitive element 41 after transferring is removed by a cleaning means (cleaning unit) 47 equipped with a cleaning blade, and charges on the surface is eliminated by the exposing means 43. Thereby the process is completed.

Incidentally, the configuration (or form) of the electrophotographic photosensitive element may be selected depending on the configuration (or form) of the electroconductive support without particular limitation, e.g., may be in the form of a dram (or a roll or cylinder) as shown in the Fig., or may be a flat form such as a belt (or a sheet).

Examples of the charging instrument usable in the charging means or the transferring means may include a conventional charging instrument, e.g., a corotron, a scorotron, a solid charging instrument, and a charging roller. Incidentally, in the transferring means, a plurality of transferring means, for example a transferring charger and a separating charger, may be used in combination.

The exposure wavelength of the light source in the exposure means is not particularly limited to a specific one, and for example, is about 100 to 1000 nm, preferably about 200 to 900 nm, and more preferably about 300 to 800 nm.

Moreover, the light source of the exposure means may be selected according to the sensitizing wavelength of the photosensitive element without limitation to a specific one. The light source may include a fluorescent lamp, a tungsten lamp, a halogen lamp, a mercury lamp, a sodium lamp, a light emitting diode (LED), a laser [for example, a laser diode (LD), an excimer laser (e.g., XeCl (308 nm), KrF (248 nm), KrCl (222 nm), ArF (193 nm), ArCl (172 nm), and $F_2$ (157 nm))], an electroluminescence (EL), and others. Incidentally, the exposure means may be equipped with a filter or the like in order to tune (or adjust) the wavelength of the light source.

As the toner of the development unit, there may be used a toner obtained by a powdering method, a toner obtained by a suspension polymerization method, or others. The toner may be a black toner, and a color toner (e.g., a yellow toner, a red toner, or a blue toner).

In the cleaning means, a cleaning method is not particularly limited to a specific one, and may be a blade cleaning method using a cleaning blade as shown in the Figure, a brush cleaning method using a cleaning brush (such as a fur brush or a magnetic fur brush), or a combination method thereof.

According to the present invention, water repellency and lubricity in the electrophotographic photosensitive element can be improved and an image having a high quality over a long term can be formed. Moreover, even in the case of wearing a surface layer of the electrophotographic photosensitive element, durability can be significantly improved without deterioration in a property such as a lubricating property or a cleaning property. Further, the electrophotographic photosensitive element realizes a high definition image without deterioration in a mechanical property or transparency, and ensures conservation of a high-quality image property even with prolonged application.

INDUSTRIAL APPLICABILITY

The electrophotographic photosensitive element and electrophotographic apparatus of the present invention is available for a variety of apparatus, e.g., various image-forming apparatuses such as a copying machine, a facsimile, and a printer (e.g., a laser printer). These image-forming apparatuses may be capable of forming a color image. The photo sensitive element may be fixed and mounted on these apparatuses, or mounted thereon in the form of an exchangeable cartridge.

EXAMPLES

The following examples are intended to describe this invention in further detail and should by no means be interpreted as defining the scope of the invention. Incidentally, the term "part(s)" indicates the part(s) by weight in EXAMPLES.

Example 1

(Preparation of Liquid Coating Composition for Charge-generating Layer)

One part of a Y-type TiOPc (oxotitanyl phthalocyanine, manufactured by Sanyo Color Works, Ltd.), 0.8 part of a polyvinylbutyral resin (trade name: S-LEC BM-S, manufactured by Sekisui Chemical Co., Ltd.), and 50 parts of cyclohexanone were mixed, and subjected to ball mill dispersion with zirconia beads for 24 hours to obtain a liquid coating composition for a charge-generating layer.

(Preparation of Liquid Coating Composition for Charge-transporting Layer)

Ten parts of a bisphenol Z-based polycarbonate (trade name "Iupilon", manufactured by Mitsubishi Gas Chemical Company, Inc.) as a binder, 10 parts of N,N'-diphenyl-N,N'-di(m-tolyl)-p-benzidine (TPD) as a charge-transporting agent, 0.2 part of decaphenylcyclosilane (five-membered ring, hereinafter represented by "PDPS"), and 42 parts of monocyclobenzene and 18 parts of dichloromethane as solvents were mixed, and subjected to dispersion with a roller mill for 24 hours to obtain a liquid coating composition for a charge-transporting layer.

Incidentally, "PDPS" was prepared as follows.

That is, to a round flask (internal volume: 1000 ml) equipped with a three-way stopcock, 30.0 g of granular magnesium (particle size: 20 to 1000 μm), 40.0 g of anhydrous lithium chloride (LiCl) and 20.0 g of anhydrous iron chloride (II) ($FeCl_2$) were fed, and driedwithheating at 50° C. under a reduced pressure of 1 mmHg (=133 kPa). Thereafter, dry argon gas was introduced into the reaction vessel, 500 ml of tetrahydrofuran pre-dried with sodium-benzophenone ketyl was added thereto, and stirred for about 30 minutes at a room temperature. Diphenyldichlorosilane (30 g) purified by distillation was added to the mixture by a dropping funnel, and the resulting mixture was stirred at 50° C. for about 24 hours. After completion of the reaction, 250 ml of 1N (=1 mol/L) hydrochloric acid was put in the reaction mixture, and the reaction mixture was subjected to extraction with 1000 ml of toluene. The toluene layer was washed in three steps with 200 ml aliquots of purified water, and was dried with anhydrous magnesium sulphate, then toluene was removed to give a cyclic polydiphenylsilane (5-membered ring) as a white powder (molecular weight based on mass spectrum (MS): 910, yield: 70%).

(Evaluations of Water Repellency and Silicon Component Dispersibility)

An aluminum sheet having a thickness of 50 μm was used as a substrate, and a liquid coating composition for a charge-transporting layer was coated on the substrate by a bar coating method using a wire bar (No. 50), and dried at 120° C. for 60 minutes to give a thin layer of a charge-transporting layer having a thickness of 15 μm. Concerning the obtained thin layer, the contact angle of water was measured.

Figure 5:
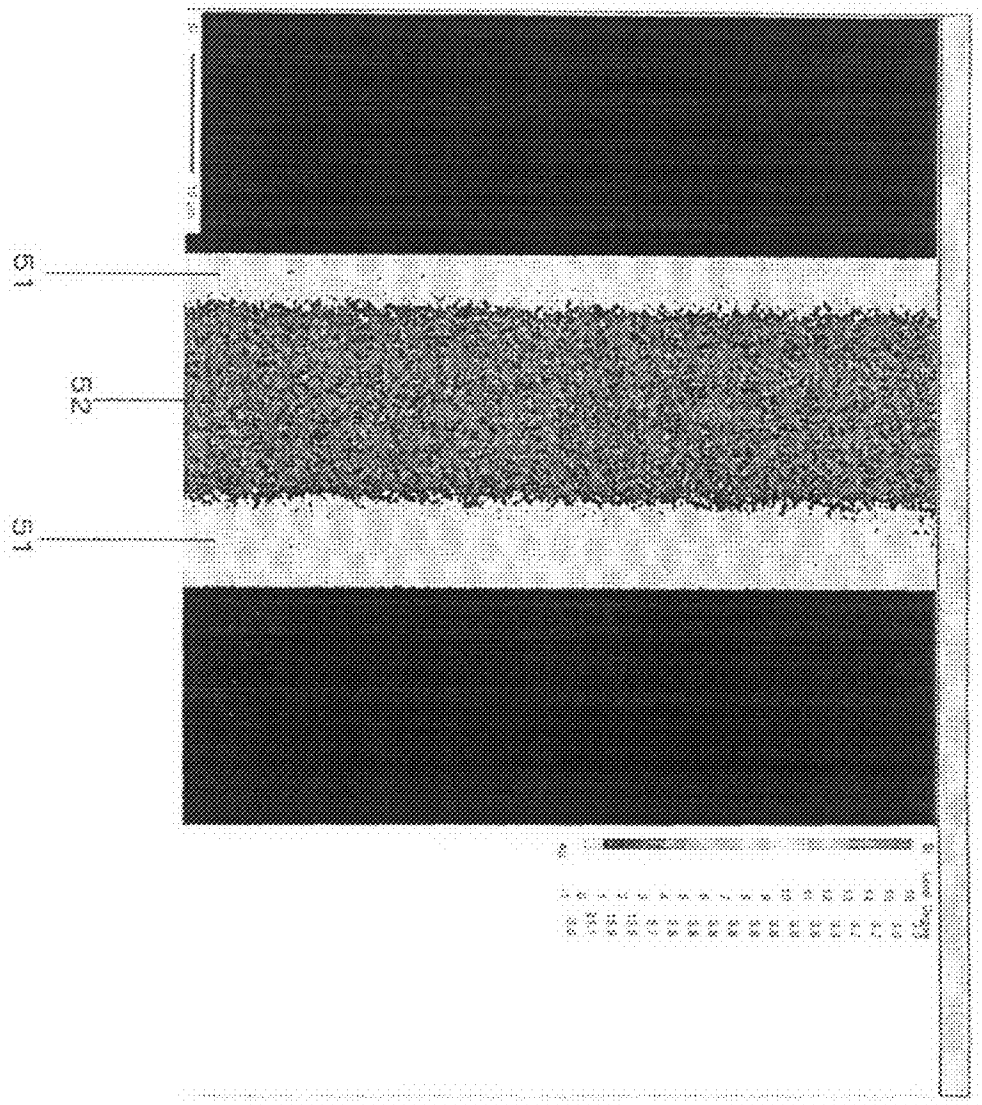
FIG. 5 is a figure showing a result of analysis of a composition distribution of a thin coat obtained in Example 1.

Moreover, the charge-transporting layer was separated from the aluminum sheet substrate, then filled in an epoxy resin, and the epoxy resin is cured. The resulting matter was polished by using an emery paper so that the cross section of the charge-transporting layer appeared. In order to impart conductivity to the matter, gold (Au) was deposited at a thickness of 100 nm on the polished surface by using a sputtering method to give a sample for chemical composition analysis. Regarding the cross section of the obtained sample, the chemical composition analysis was conducted by using an electron probemicroanalysis (EPMA) method (analyzer: "JXA-8900RL", manufactured by JEOL, Ltd.). From the distribution results, the uniform dispersibility of the silicon component to the cross section of the coat was evaluated. FIG. 5 is a figure showing a result of analysis of a composition distribution in the cross section of the charge-transporting layer. In FIG. 5, the white parts on both sides in the thickness direction are an epoxy resin 51, and the central part is a charge-transporting layer 52. As apparent from FIG. 5, the polysilane was uniformly dispersed in the charge-transporting layer 52.

In the upper right hand corner of FIG. 5, a shaded bar with the corresponding level and degree of the relative distribution of Silicon (Si) and Gold (Au) is shown for use in interpreting FIG. 5.

(Printing Test)

An aluminum tube (conductive support) having an external diameter of 30 mm was dipped in a methyl alcohol solution containing a nylon resin (trade name "Amilan CM8000", manufactured by Toray Industries, Inc.) mixed in a proportion of 5% by weight, and dried at 80° C. for 20 minutes to form an undercoat layer having a thickness of 0.8 μm. Then, the liquid coating composition for a charge-generating layer was dipped on this undercoat layer, and dried at 80° C. for 10 minutes to form a charge-generating layer having a thickness of 0.3 μm. Further, the liquid coating composition for a charge-transporting layer was dipped on this charge-generating layer, and dried at 120° C. for 60 minutes to form a charge-transporting layer having a thickness of 22 μm, and a drum-like electrophotographic photosensitive element was produced.

The obtained electrophotographic photosensitive element was loaded in a testing machine obtained by making alterations to a commercially available laser printer equipped with an electrophotographic apparatus similar to FIG. 4 mentioned above, and the printing image was evaluated with the testing machine after actually printing. Incidentally, in the laser printer, the charging means 42 comprises a corona charging instrument, and the light-exposing means 43 comprises a laser diode (wavelength: 780 nm). The image evaluation was based on a test pattern having solid and thin line parts, and an initial printed image obtained by printing the test pattern and an printed image obtained after printing 20000 sheets of the test pattern were visually determined. Moreover, the decreased thickness (abrasion loss) of the photosensitive element after printing 20000 sheets of the test pattern was measured.

Example 2

A photosensitive element was made in the same manner as Example 1 except that the amount of PDPS in the liquid coating composition for a charge-transporting layer was 0.5 part instead of 0.2 part, and was evaluated similar to Example 1.

Comparative Example 1

A photosensitive element was made in the same manner as Example 1 except that the liquid coating composition for a charge-transporting layer was prepared without adding PDPS, and was evaluated similar to Example 1.

Comparative Example 2

A photosensitive element was made in the same manner as Example 1 except that 0.1 part of methylphenylsilicone ("KF56", manufactured by Shin-Etsu Silicones) was used instead of 0.2 part of PDPS in the liquid coating composition for a charge-transporting layer in Example 1, and was evaluated similar to Example 1.

Comparative Example 3

A photosensitive element was made in the same manner as Example 1 except that 0.2 part of methylphenylsilicone ("KF56", manufactured by Shin-Etsu Silicones) was used instead of 0.2 part of PDPS in the liquid coating composition for a charge transfer layer in Example 1, and was evaluated similar to Example 1.

Comparative Example 4

A photosensitive element was made in the same manner as Example 1 except that 2.5 parts of a linear poly(methylphenylsilane) (PMPS, number-average molecular weight of 12000, weight-average molecular weight of 23000) was used instead of 0.2 part of PDPS in the liquid coating composition for a charge-transporting layer in Example 1, and was evaluated similar to Example 1.

Incidentally, PMPS was prepared as follows.

To a round flask (internal volume: 1000 ml) equipped with a three-way stopcock, 60.0 g of granular magnesium (particle size: 20 to 1000 μm), 16.0 g of anhydrous lithium chloride (LiCl) and 9.6 g of anhydrous iron chloride (II) ($FeCl_2$) were fed, and the mixture was dried with heating at 50° C. under a reduced pressure of 1 mmHg (=133 kPa). Thereafter, dry argon gas was introduced into the reaction vessel, 540 ml of tetrahydrofuran pre-dried with sodium-benzophenone ketyl was added thereto, and stirred for about 30 minutes at a room temperature. Sixty-four (64) ml of methylphenyldichlorosilane purified by distillation was added to the mixture by a syringe, and the resulting mixture was stirred at a room temperature for about 12 hours. After completion of the reaction, 500 ml of 1N hydrochloric acid was put in the reaction mixture, and the reaction mixture was subjected to extraction with 1000 ml of diethyl ether. The ether layer was washed in two steps with 500 ml aliquots of purified water, and was dried with anhydrous magnesium sulphate, and then ether was removed to give a crude polysilane containing a low molecular weight by-product. The crude polysilane was reprecipitated with 200 ml of tetrahydrofuran as a good solvent and 4000 ml of ethanol as a poor solvent to obtain a PMPS [number-average molecular weight of 12000, weight-average molecular weight of 23000, and yield of 85%, in accordance with gel-permeation chromatography (GPC) (in terms of polystyrene)].

The results were shown in Table 1. Incidentally, in Table 1, "A" represents the cyclic PDPS, "B" represents the methylphenylsilicone, "C" represents the linear PMPS, and the dispersibility of the silicon component (the cyclic polysilane, the linear polysilane, the silicone) and the image were evaluated as follows.

Dispersibility of Silicon Component

"A": the silicon component is uniformly dispersed in the whole cross section of the coat.

"B": the silicon component is unevenly distributed in the form of an islands-in-an ocean structure.

"C": the silicon component is unevenly distributed in the top surface layer.

Evaluation of image

"A": good

"B" to "C": blur of image and fog occur.

tion, an image was printed without deteriorating the image quality even in the case of using over a long period.

Example 3

A photosensitive element was made in the same manner as Example 1 except that 0.1 part of PDPS was used instead of 0.2 part of PDPS in the liquid coating composition for a charge transfer layer, and was evaluated similar to Example 1.

Example 4

A photosensitive element was made in the same manner as Example 1 except that 0.15 part of PDPS was used instead of 0.2 part of PDPS in the liquid coating composition for a charge transfer layer, and was evaluated similar to Example 1.

Example 5

A photosensitive element was made in the same manner as Example 1 except that 0.15 part of PDPS was used instead of 0.2 part of PDPS in the liquid coating composition for a charge transfer layer and that 7 parts of TPD was used instead of 10 parts of TPD in the charge-transporting agent, and was evaluated similar to Example 1.

Example 6

A photosensitive element was made in the same manner as in Example 1 except that 0.2 part of a cyclic diphenylsilane-methylphenylsilane copolymer (PDPMPS) was used instead of 0.2 part of PDPS in the liquid coating composition for a charge transfer layer, and was evaluated similar to Example 1.

Incidentally, the cyclic PDPMPS was prepared as follows.

That is, to a round flask (internal volume: 1000 ml) equipped with a three-way stopcock, 30.0 g of granular magnesium (particle size: 20 to 1000 μm), 40.0 g of anhydrous lithium chloride (LiCl) and 20.0 g of anhydrous iron chloride (II) ($FeCl_2$) were fed, and the mixture was dried with heating at 50° C. under a reduced pressure of 1 mmHg (=133 kPa). Thereafter, dry argon gas was introduced into the reaction vessel, 500 ml of tetrahydrofuran pre-dried with sodium-benzophenone ketyl was added thereto, and stirred for about 30 minutes at a room temperature. A mixture of diphenyldichlorosilane (30.4 g (0.12 mol)) purified by distillation and methylphenyldichlorosilane (5.7 g (0.03 mol)) purified by distillation were added thereto by a dropping

TABLE 1

| | Additive | Amount (part) | Contact angle (°) | Dispersibility of silicon component | Transparency | Evaluation of image: Initial | Evaluation of image: After 20000 printing | Abrasion loss (μm) |
|---|---|---|---|---|---|---|---|---|
| Ex. 1 | A | 0.2 | 85 | A | Good | A | A | 1.5 |
| Ex. 2 | A | 0.5 | 86 | A | Good | A | A | 1.4 |
| Com. Ex. 1 | none | 0 | 76 | — | Good | A | C | 5.6 |
| Com. Ex. 2 | B | 0.1 | 85 | C | slightly clouded | B | C | 4.1 |
| Com. Ex. 3 | B | 0.2 | 85 | C | slightly clouded | B | C | 3.8 |
| Com. Ex. 4 | C | 2.5 | 87 | B | clouded | C | C | 6.6 |

As apparent from Table 1, in Examples, even when the amount to be used of the silicon component was small compared with Comparative Examples, the photosensitive element could highly improve the water repellency and durability without deteriorating the transparency. In addifunnel, and the resulting mixture was stirred at 50° C. for about 24 hours. After completion of the reaction, 250 ml of 1N (=1 mol/L) hydrochloric acid was put in the reaction mixture, and the reaction mixture was subjected to extraction with 1000 ml of toluene. The toluene layer was washed in three steps with 200 ml aliquots of purified water, and dried with anhydrous magnesium sulphate, then toluene was removed to give a mixture of a cyclic polydiphenylsilane (5-membered ring) and a cyclic diphenyldichlorosilane-methylphenyldichlorosilane copolymer (4- to 6-membered ring) as a white solid [number-average molecular weight of 950, weight-average molecular weight of 1020 and yield of 85%, in accordance with gel-permeation chromatography (GPC) (conversion in terms of polystyrene)].

Example 7

Except for using a bisphenol A-based polycarbonate (trade name: "Iupilon E-2000", manufactured by Mitsubishi Gas Chemical Company, Inc.) instead of the bisphenol Z-based polycarbonate and using dichloromethane instead of monochlorobenzene as a solvent, an operation was conducted in the same manner as Example 1.

Example 8

An operation was conducted in the same manner as Example 1 except that a copolycarbonate of biphenol and bisphenol A (trade name "Tough Z", manufactured by Idemitsu Kosan Co., Ltd.) was used instead of the bisphenol Z-based polycarbonate.

Example 9

An operation was conducted in the same manner as Example 1 except that a copolycarbonate of 9,9-bis(4-hydroxy-3-methylphenyl)fluorene and bisphenol A prepared in accordance with Example 1 of Japanese Patent Application Laid-Open No. 134198/1996 (JP-8-134198A) was used instead of the bisphenol Z-based polycarbonate.

Comparative Example 5

A photosensitive element was made in the same manner as Example 1 except that 0.2 part of a linear poly(diphenylsilane) PDPS (number-average molecular weight: 2200, weight-average molecular weight: 3400) was used instead of 0.2 part of PDPS in the liquid coating composition for a charge transfer layer, and was evaluated similar to Example 1.

Incidentally, the linear PDPS was prepared as follows.

A stirrer, a Dimroth condenser, a thermometer, and a 100 ml dropping funnel were installed in a four-neck round flask (internal volume: 1000 ml). Dry argon gas was passed through the flask, and the flask was allowed to stand overnight. In the flask, 24.0 g of metallic sodium and 350 ml of dry toluene were charged, and boiled up in an oil bath. On the other hand, 90.0 g of diphenyldichlorosilane was fed in the dropping funnel, and gradually dropped over 40 minutes. After completion of the dropping, the mixture was kept boiling for another 2 hours, and cooled down to complete the reaction. Thereafter, 100 ml of methanol was gradually dropped in the mixture to consume the remaining metallic sodium. Then the reaction mixture was transferred to a separating funnel, and the by-product sodium chloride was repeatedly extracted from the mixture with 200 ml of water. The organic layer was dried with anhydrous magnesium sulphate, and then the solvent was removed to give 48 g of a crude polysilane.

The crude polysilane was dissolved in 200 ml of tetrahydrofuran, and 500 ml of acetone was gently added thereto with stirring to reprecipitate the polysilane. The precipitate was separated by filtration, and dried to give a linear polydiphenylsilane.

TABLE 2

| | Additive | Amount (part) | Contact angle (°) | Dispersibility | Transparency | Image | | Abrasion loss (μm) |
|---|---|---|---|---|---|---|---|---|
| | | | | | | Initial | After 20000 printing | |
| Ex. 3 | A | 0.1 | 83 | A | Good | A | A | 1.7 |
| Ex. 4 | A | 0.15 | 85 | A | Good | A | A | 1.5 |
| Ex. 5 | A | 0.15 | 86 | A | Good | A | A | 1.3 |
| Ex. 6 | D | 0.2 | 85 | A | Good | A | A | 1.6 |
| Ex. 7 | A | 0.2 | 84 | A | Good | A | A | 3.3 |
| Ex. 8 | A | 0.2 | 85 | A | Good | A | A | 2.1 |
| Ex. 9 | A | 0.2 | 85 | A | Good | A | A | 1.9 |
| Com. Ex. 5 | E | 0.2 | 79 | B | generation of particles | C | C | 5.5 |

Incidentally, in Example 5, 7 parts of TPD was used. In the column of "Additive" in Tables, "A" represents the 5-membered cyclic PDPS, "D" represents the cyclic diphenylsilane-methylphenylsilane copolymer, and "E" represents the linear PDPS.

The invention claimed is:

1. An electrophotographic photosensitive element comprising at least a top surface layer containing a polysilane, wherein the polysilane comprises a cyclic polysilane represented by the following formula (1):

(1)

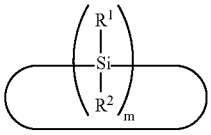

wherein $R^1$ and $R^2$ are the same or different from each other and each represents an alkyl group, a cycloalkyl group, an aryl group, or an aralkyl group, at least one hydrogen atom of the alkyl group, the cycloalkyl group, the aryl group, or the aralkyl group, may be substituted with an alkyl group, a cycloalkyl group, an aryl group, or an aralkyl group;

"m" denotes an integer of not less than 4; and $R^1$ and $R^2$ may vary depending on the coefficient "m", respectively.

2. An electrophotographic photosensitive element according to claim 1, wherein, in the formula (1), at least one of $R^1$ and $R^2$ represents an aryl group, and "m" is an integer of 4 to 10.

3. An electrophotographic photosensitive element according to claim 1, wherein, in the formula (1), $R^1$ and $R^2$ each represents a phenyl group, and "m" is an integer of 4 to 8.

4. An electrophotographic photosensitive element according to claim 1, wherein the cyclic polysilane is represented by the following formula (1a):

(1a)

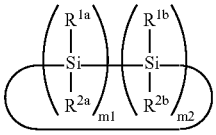

wherein $R^{1a}$ and $R^{2a}$ each represents an aryl group in which at least one hydrogen atom thereof may be substituted with an alkyl group;

$R^{1b}$ and $R^{2b}$ are the same or different from each other and each represents an alkyl group which at least one hydrogen atom thereof may be substituted with a $C_{5-8}$cycloalkyl group or a $C_{6-10}$aryl group, a cycloalkyl group in which at least one hydrogen atom thereof may be substituted with a linear or branched $C_{1-4}$alkyl group, a $C_{5-8}$cycloalkyl group or a $C_{6-10}$aryl group, or an aryl group in which at least one hydrogen atom thereof may be substituted with an alkyl group;

provided that both $R^{1b}$ and $R^{2b}$ are not coincidentally an aryl group in which at least one hydrogen atom thereof may be substituted with an alkyl group;

m1 denotes an integer of not less than 1;

m2 denotes 0 or an integer of not less than 1; and m1+m2 denotes an integer of not less than 4.

5. An electrophotographic photosensitive element according to claim 4, wherein $R^{1a}$ and $R^{2a}$ each represents a $C_{6-10}$aryl group;

a combination of $R^{1b}$ and $R^{2b}$ is (1) a combination of a $C_{1-4}$alkyl group and a $C_{1-4}$alkyl group, (2) a combination of a $C_{1-4}$alkyl group and a $C_{6-10}$aryl group, (3) a combination of a $C_{1-4}$alkyl group and a $C_{5-8}$cycloalkyl group, or (4) a combination of a $C_{6-10}$aryl group and a $C_{5-8}$cycloalkyl group.

6. An electrophotographic photosensitive element according to claim 4, wherein m1 is an integer of 1 to 10, m2 is an integer of 0 to 10, and m1+m2 is 4 to 12.

7. An electrophotographic photosensitive element according to claim 4, wherein m1 is an integer of 1 to 8, m2 is an integer of 0 to 8, and m1+m2 is 4 to 10.

8. An electrophotographic photosensitive element according to claim 1, wherein the polysilane is a polysilane mixture containing a cyclic polysilane.

9. An electrophotographic photosensitive element according to claim 8, wherein the top surface layer comprises an outer surface layer of the photosensitive layer or a surface protection layer of the photosensitive layer, and the proportion of a cyclic homo- or copolysilane having at least a diarylsilane unit is 0.01 to 3% by weight relative to whole components of the top surface layer.

10. An electrophotographic photosensitive element according to claim 1, which comprises at least both of an electroconductive support and a photosensitive layer, wherein the photosensitive layer comprises at least the following components:

a charge-generating agent;

a charge-transporting agent; and a binder resin.

11. An electrophotographic photosensitive element according to claim 10, wherein the photosensitive layer comprises a charge-generating layer, and a charge-transporting layer formed on the charge-generating layer.

12. An electrophotographic photosensitive element according to claim 10, wherein a surface protection layer containing the polysilane is formed on the photosensitive layer.

13. An electrophotographic photosensitive element according to claim 1, wherein the content of the cyclic polysilane is 0.01 to 10% by weight relative to the whole components of the top surface layer.

14. An electrophotographic photosensitive element according to claim 1, wherein the content of the cyclic polysilane is 0.01 to 5% by weight relative to the whole components of the top surface layer.

15. A method for producing an electrophotographic photosensitive element recited in claim 1, which comprises forming at least a photosensitive layer on an electroconductive support to obtain the electrophotographic photosensitive element, wherein a cyclic polysilane recited in claim 1 is incorporated into at least a top surface of the electrophotographic photosensitive element.

16. An electrophotographic photosensitive element composition, which comprises a component for an outer surface layer of a photosensitive layer or a component for a surface protection layer of a photosensitive layer, and a cyclic polysilane recited in claim 1.

17. A composition according to claim 16, which comprises a binder, a cyclic polysilane, and at least one member selected from the group consisting of a charge-generating agent and a charge-transporting agent.

18. A composition according to claim 17, wherein the binder comprises a polycarbonate-series resin.

19. An electrophotographic cartridge, which is provided with an electrophotographic photosensitive element recited in claim 1.

20. An electrophotographic apparatus, which is provided with an electrophotographic photosensitive element recited in claim 1.

* * * * *